United States Patent [19]

Brewer et al.

[11] Patent Number: 4,516,882

[45] Date of Patent: May 14, 1985

[54] METHOD AND APPARATUS FOR CONVERSION OF SEMI-SUBMERSIBLE PLATFORM TO TENSION LEG PLATFORM FOR CONDUCTING OFFSHORE WELL OPERATIONS

[75] Inventors: John H. Brewer, Irvine; Hobart A. Cress, Rancho Palos Verdes, both of Calif.

[73] Assignee: Fluor Subsea Services, Inc., Irvine, Calif.

[21] Appl. No.: 387,419

[22] Filed: Jun. 11, 1982

[51] Int. Cl.[3] ..... E02B 17/00; B63B 35/44

[52] U.S. Cl. ..... 405/224; 405/205; 405/206; 114/265

[58] Field of Search ..... 405/224, 196, 203-208; 114/264, 265; 175/5-7

[56] References Cited

U.S. PATENT DOCUMENTS

| | | | |
|---|---|---|---|
| 2,987,892 | 6/1961 | Reeve | 405/200 |
| 3,490,406 | 1/1970 | O'Reilly et al. | 405/207 X |
| 3,577,946 | 5/1971 | Horton | 405/207 X |
| 3,780,685 | 12/1973 | Horton | 114/265 |
| 3,894,503 | 7/1975 | McClure | 114/265 |
| 3,982,401 | 9/1976 | Loggins | 175/7 X |
| 4,040,265 | 8/1977 | Hellerman et al. | 405/196 |
| 4,226,555 | 10/1980 | Bourne et al. | 405/224 |

*Primary Examiner*—Dennis L. Taylor

*Attorney, Agent, or Firm*—Poms, Smith, Lande & Rose

[57] ABSTRACT

A method of conducting offshore well operations including exploration drilling and production from a single floatable platform which is converted from semisubmersible exploration mode to tension leg production mode at a well site. A method of conversion of platform from catenary mooring mode in which exploration and drilling operations are conducted from the platform in semisubmersible mode at the well site to establish production capabilities and upon determining the well site should be produced to tension leg mode for production including the steps of, preparing to conduct production operations in tension leg mode by lowering and setting anchor pile guide means carried by the platform at selected anchor locations, shifting the platform in semisubmersible mode for drilling at each anchor pile guide means, setting permanent anchor pile members in the sea floor at the anchor pile guide means, connecting a tension leg means to the anchor pile members and to said platform, initially tensioning said tension leg means to a selected tension, then releasing said platform from said catenary mooring mode, and further tensioning said tension leg means for operation of said platform in tension leg production mode. A mobile offshore marine platform for conducting exploratory drilling operations in semisubmersible catenary anchor mode and for conducting production activities in tension leg production mode wherein conversion means includes anchor means carried by the platform, means on the platform for installing the anchors while the platform is in catenary anchor mode and tension leg means for interconnecting the anchor means and the platform.

28 Claims, 21 Drawing Figures

51
80
81
82
83
84
85
86
87
88
90
91
22
64
133

248
56
60
247
248
249
243
242
241
235
59
244
240
240
239
239
245
236
236
238
237
233
232
232a
234
22
231
230
58
56
52

288a
296a
296
295
288
298
287
283

METHOD AND APPARATUS FOR CONVERSION OF SEMI-SUBMERSIBLE PLATFORM TO TENSION LEG PLATFORM FOR CONDUCTING OFFSHORE WELL OPERATIONS

BACKGROUND OF THE INVENTION

The present invention relates to a method and apparatus for conducting offshore well operations which include exploratory drilling and which also include production operations from the same platform.

Generally speaking, offshore well operations have employed a semisubmersible vessel or platform which provides relatively great mobility and which can be located over a proposed well site, anchored by catenary temporary moorings, and moved into position for drilling exploratory well holes to determine the presence and character of a field of oil or hydrocarbons. Such semisubmersible platforms are generally designed to operate with horizontal buoyant members located beneath the influence of wave action so that the semisubmersible vessel does not substnatially react to wave influence. Exploratory drilling is conducted from such a semisubmersible vessel and is feasible by the use of various types of heave compensating means. Heretofore, after exploratory drilling was completed, if the exploratory well was not suitable for production, the semisubmersible vessel was readily moved to another well site. If the exploratory well could be produced, the well site was marked, recorded and preparations commenced to bring a permanent production platform to the site. Construction and outfitting of such a production platform was extremely costly and required a long period of time, in some instances as much as six or seven years elapsed before a production platform could be brought to the well site, installed, and production operations begun.

Prior semisubmersible platforms embodied a design of vertical and horizontal buoyant members which enhanced the mobility of the semisubmersible platform, which were operable with relatively low profile at the water surface, and which utilized catenary mooring lines held by temporary anchors at the sea floor and located a distance from the well site. A tension leg platform embodies a different hydrodynamic design and is superior for field development and production because the design characteristics eliminate heave, pitch and roll of the platform. Thus, a tension leg platform is quite stable and can be a relatively permanent installation. Since the hydrodynamic design of a tension leg platform is different than the design of a semisubmersible platform, the conduct of offshore well operations has heretofore generally required the use of two different vessels for exploration and for production. Tension leg platform design has been optimized for minimum variation of mooring tension, whereas semisubmersible vessel design has been optimized for minimum heave response with catenary mooring. Prior semisubmersible constructions and prior tension leg platform constructions have been generally equipped for one or the other type of operation; namely, either exploratory operations or production operations.

SUMMARY OF INVENTION

The present invention relates to a method and apparatus for conducting offshore well operations in which a single platform is designed for and capable of temporary exploration and permanent production operations.

The invention contemplates that the single platform can be operated in one mode as a semisubmersible platform provided with catenary mooring and is adapted to be readily converted to a tension leg platform adapted for tension leg mooring.

The primary object of the present invention, therefore, is to provide a dual purpose platform having a design useful for operation as a tension leg platform and or a semisubmersible platform.

An object of the invention is to provide a dual purpose mobile marine offshore platform provided with means for operation of the platform in a catenary mooring mode and also provided with means for operation of the platform in a taut or tension leg mode.

Another object of the invention is to provide a mobile dual purpose platform adapted to be converted from a semisubmersible operation to a tension leg operation in a novel method and manner.

A specific object of the invention is to provide a single mobile platform designed as a platform with tension leg platform characteristics including buoyancy and displacement relationships to neutralize vertical forces acting on the platform and to modify such a platform to provide operation of the platform in a semisubmersible mode in which virtual mass trap means to control heave response in semisubmersible mode are provided and made inoperable for tension leg mode.

Another specific object of this invention is to disclose an offshore platform having mass trap means carried thereby and a method and construction for installing and removing the mass trap means.

A further object of the present invention is to provide a mobile offshore marine platform including a construction and arrangement for installing tension leg means while the platform is in a catenary mooring mode.

The present invention contemplates a novel method of conducting offshore well operations in which exploration drilling and production is conducted from a single floatable platform in which the platform is utilized in semisubmersible exploratory mode with catenary mooring and in tension leg production mode with tension legs for minimizing heave, pitch and roll in the platform during production operations. The method contemplated by this invention includes the steps of towing a platform to an ocean well site, mooring the platform in semisubmersible mode over the site with catenary mooring lines and temporary anchor means, conducting exploration and drilling operations from the platform in semisubmersible mode at said site to establish production capabilities of the well site, lowering and setting anchor pile guide means at selected anchor locations at the well site and beneath the platform while the platform is in semisubmersible mode, shifting the platform in semisubmersible mode for drilling and installing anchor pile members at each anchor pile guide means, setting permanent anchor pile members in the sea floor at the anchor pile guide means, connecting tension leg means to said anchor pile members and to said platform, initially tensioning said tension leg means to a selected tension, releasing said platform from said catenary mooring mode and semisubmersible condition, and further tensioning said tension leg means by deballasting certain buoyant members for operation of said platform in tension leg mode for production operations.

The invention further contemplates a mobile offshore marine platform adapted to be converted from semisubmersible mode to tension leg production mode including means for anchoring the platform in semisubmersible catenary anchor mode and at a selected draft, means for converting said platform from semisubmersible catenary anchor mode to a platform in tension leg mode, the converting means including anchor pile guide means carried by said platform and adapted to be lowered to the sea floor, means on said platform for installing anchor pile members in said guide means by laterally shifting said platform in catenary anchor mode and including drill means operable through said guide means; tension leg means interconnecting said anchor pile members and said platform, means for uniformly tensioning said tension leg means, means for releasing said platform from said catenary anchor mode, and means for positioning said platform at a selected draft in tension leg mode for production operations.

Various other objects and advantages of the present invention will be readily apparent from the following description of the drawings in which an exemplary method and apparatus of this invention is shown.

IN THE DRAWINGS

Figure 5:
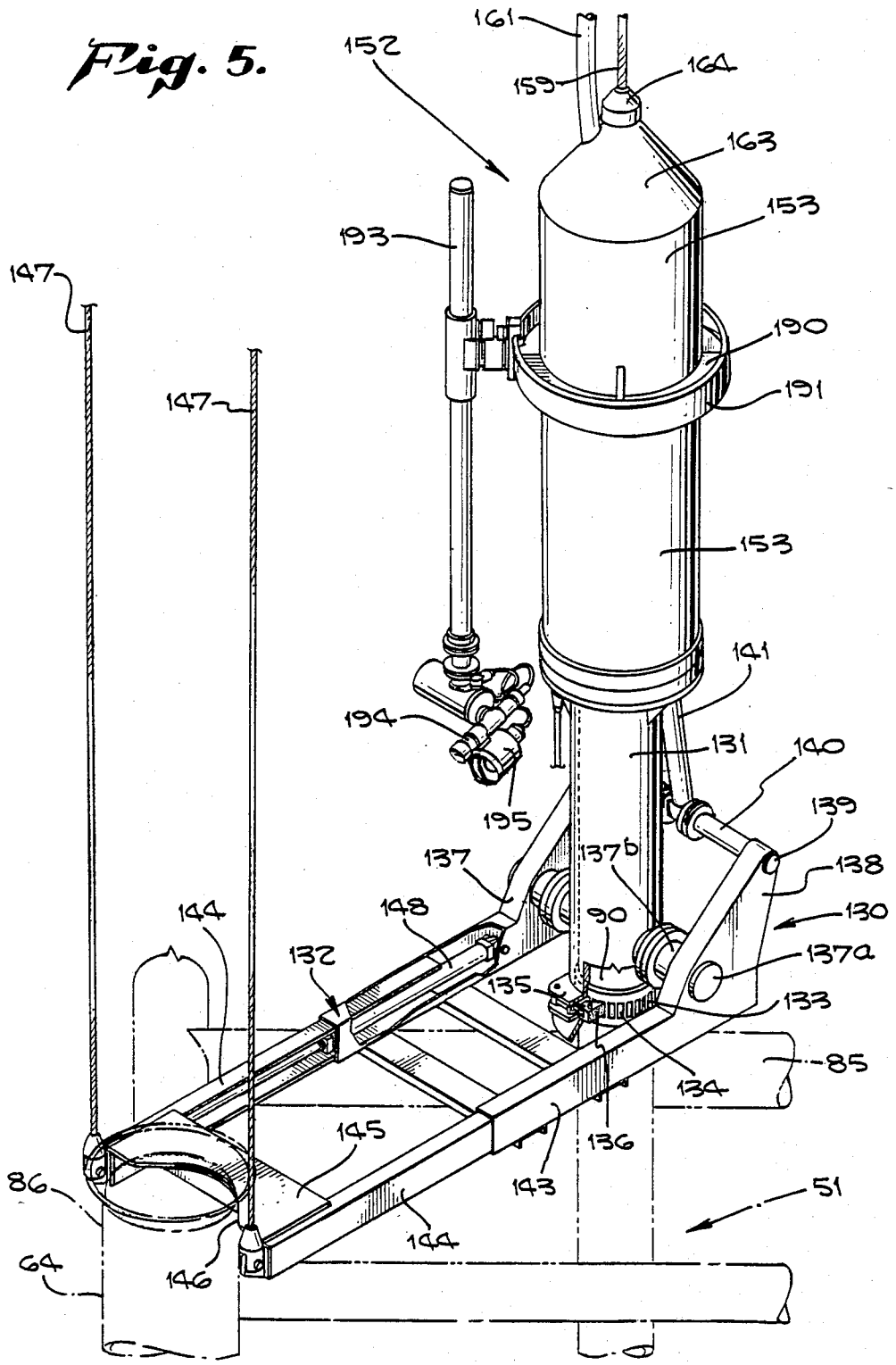
FIG. 5 is a perspective view of a retractable guide means for installation of the anchor pile and the tension member.
Figure 5A:
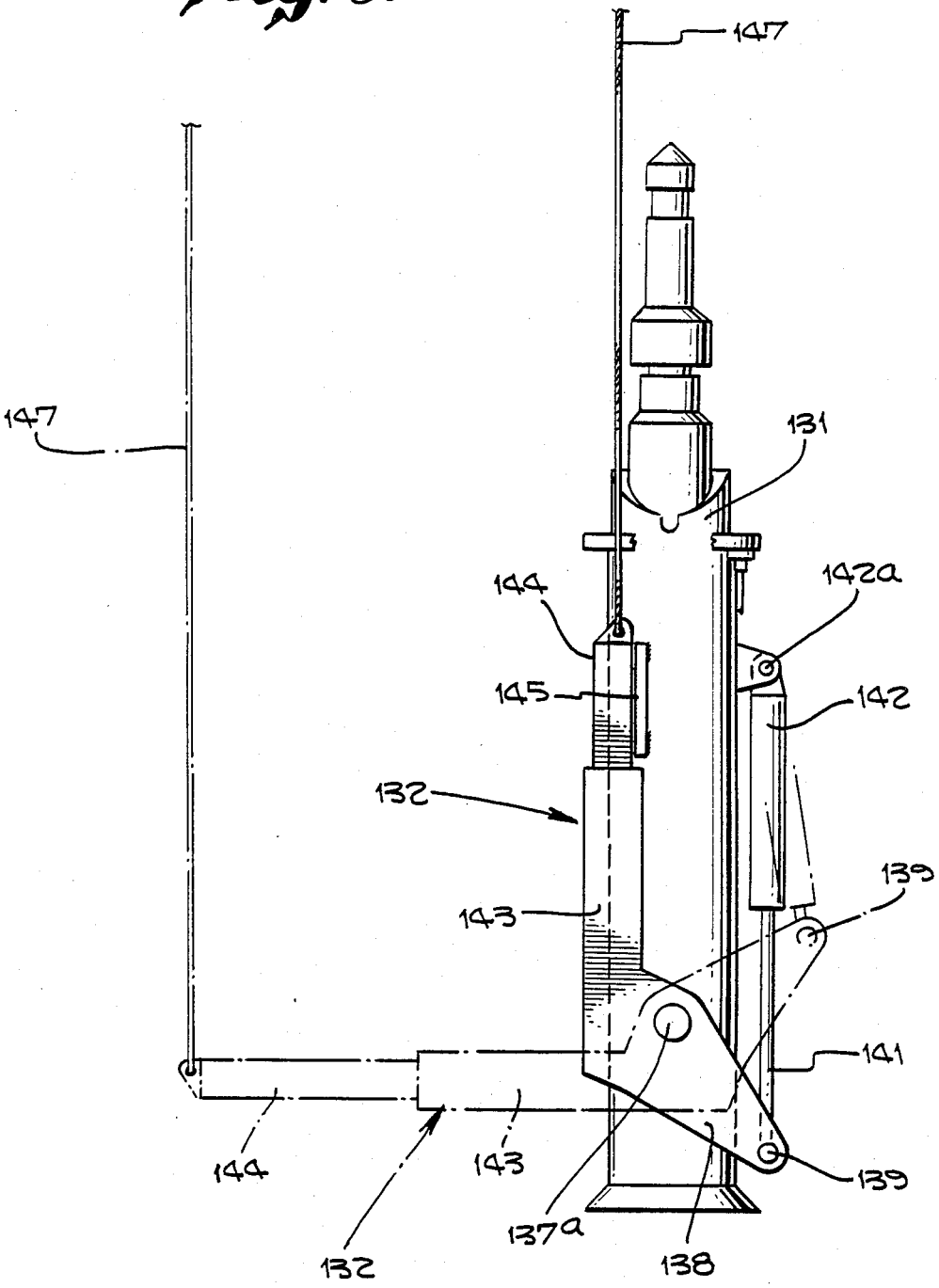

FIG. 5*a* is an elevational view of the retractable guide means in folded relation for lowering and retrieval.

Figure 6:
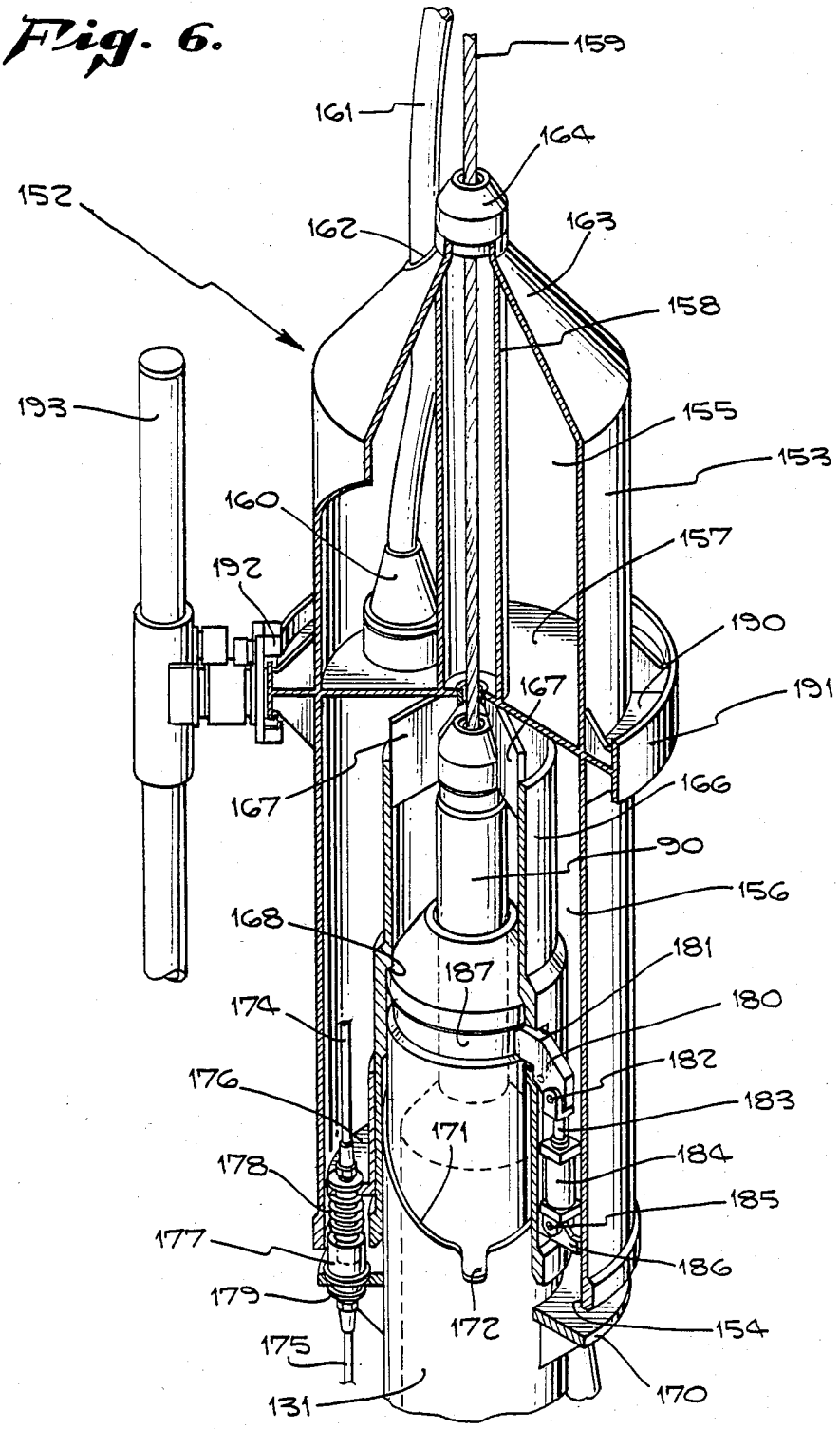

FIG. 6 is a perspective view, partly in section, of a retrievable control pod for use with the retractable guide means shown in FIG. 5.

Figure 7:
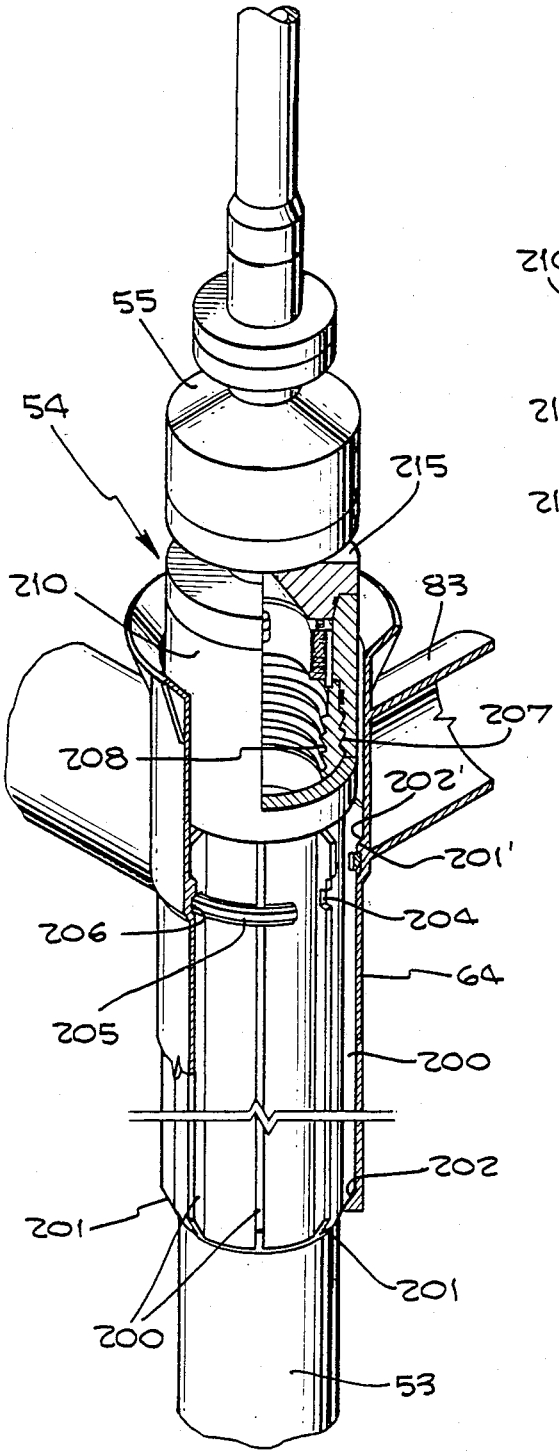

FIG. 7 is a perspective view, partly in section, of an anchor pile connector for the tension member.

Figure 8:
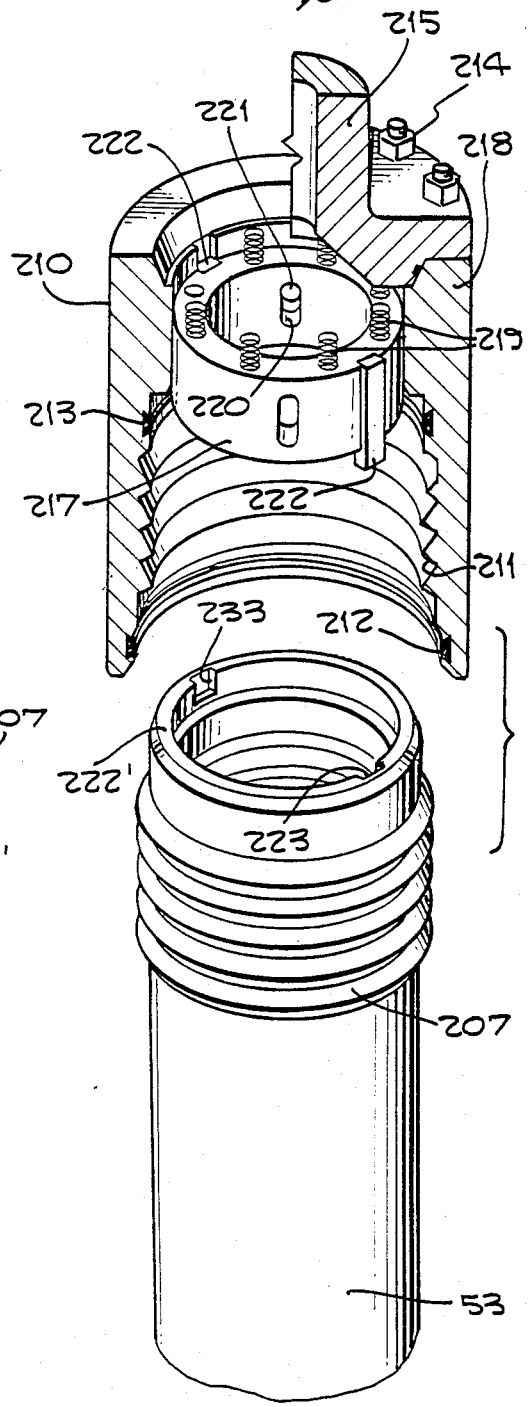

FIG. 8 is an exploded perspective view, partly in section of the anchor pile connector shown in FIG. 7.

Figure 9:
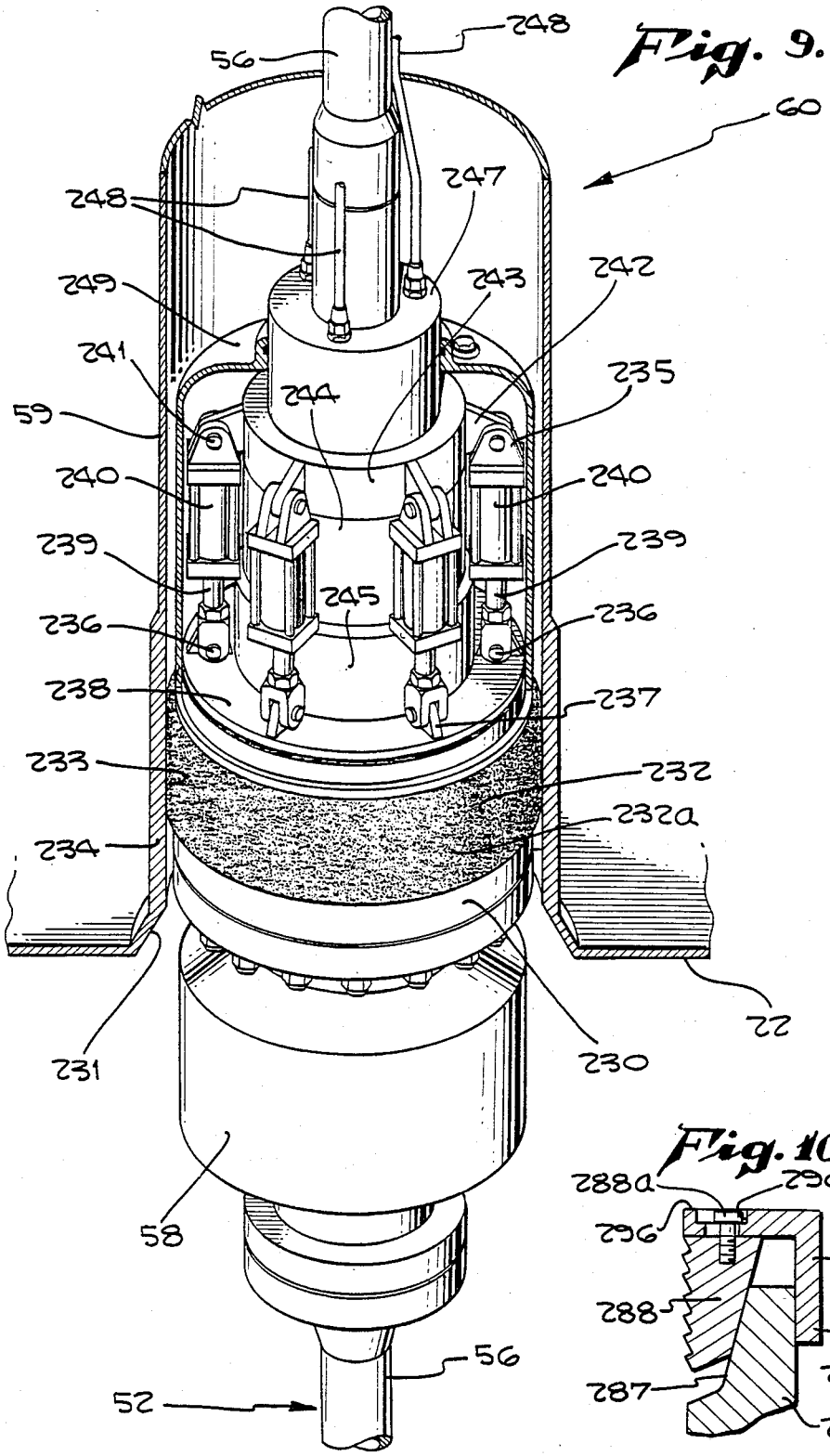

FIG. 9 is a perspective view, partly in section, of a tension member stabilizer means.

Figure 10A:
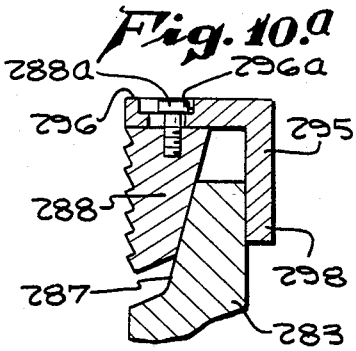
Figure 10:
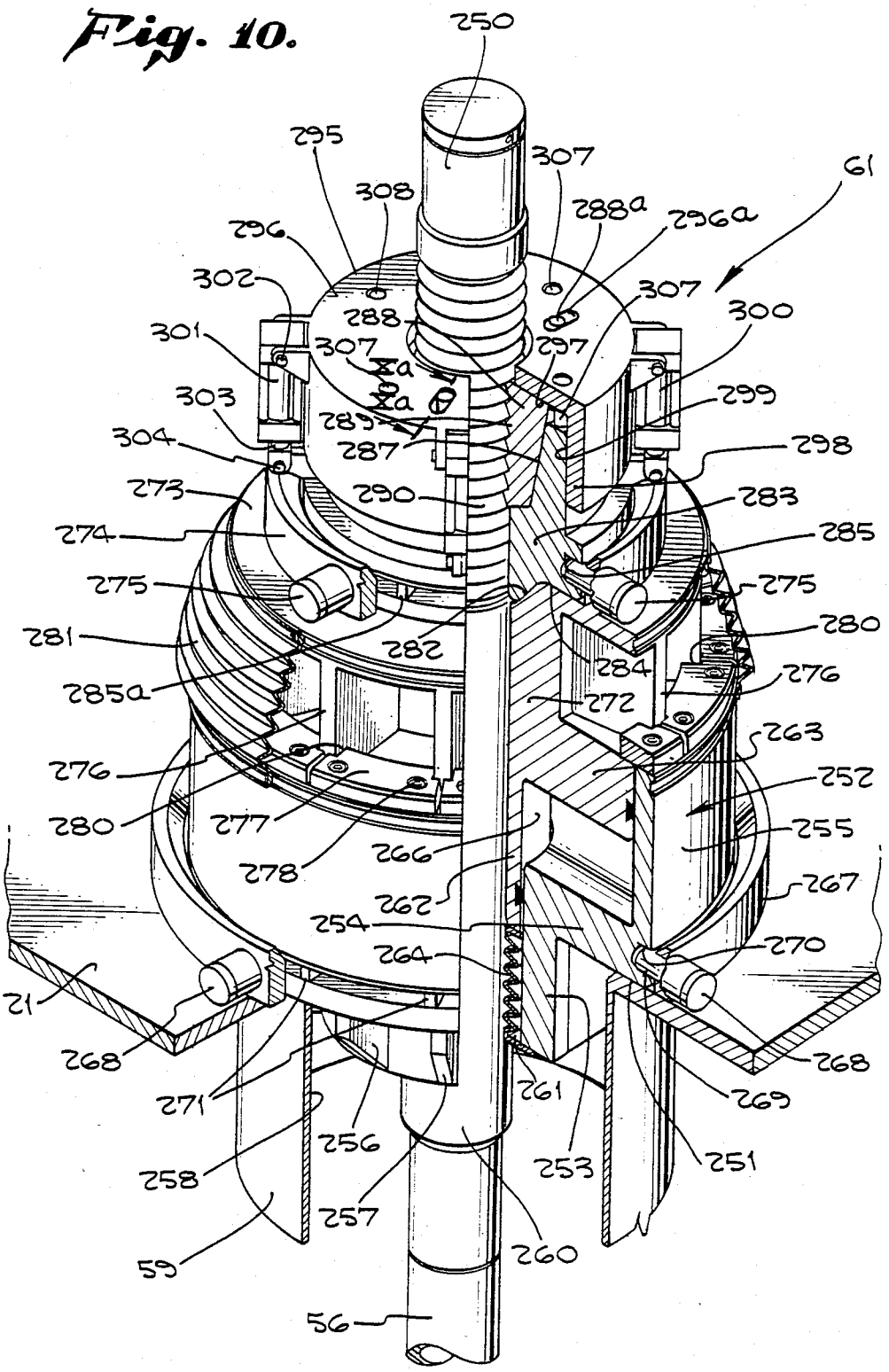

FIG. 10 is a perspective view, partly in section, of a quick latch means for the top end of the tension member.

FIG. 10*a* is a fragmentary sectional view taken in a radial plane indicated by line X*a*—X*a* of FIG. 10.

Figure 11:
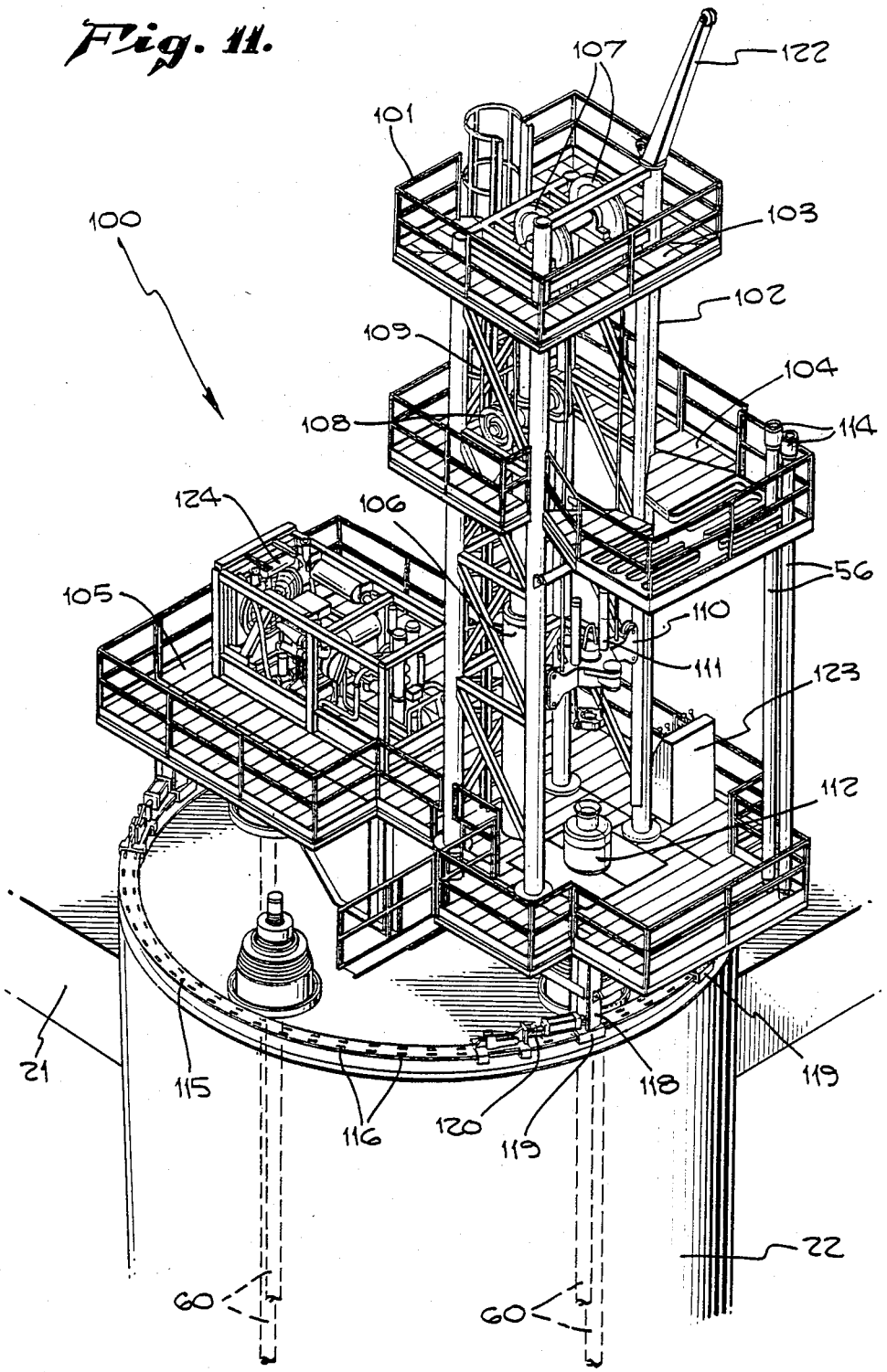

FIG. 11 is a perspective view of a tension member installation rig adapted to be mounted over each vertical column.

Figure 12:
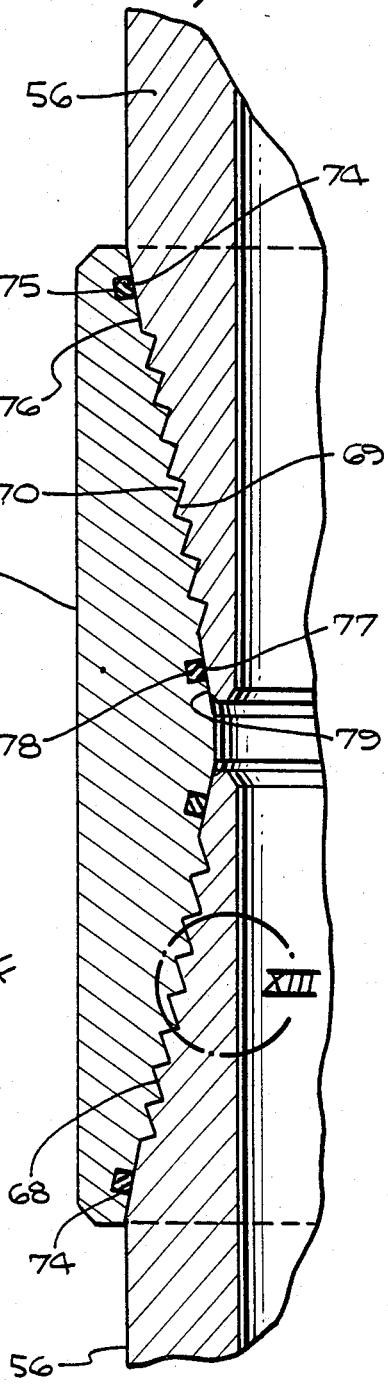

FIG. 12 is an enlarged fragmentary sectional view of a coupling used in said tension leg means.

Figure 13:
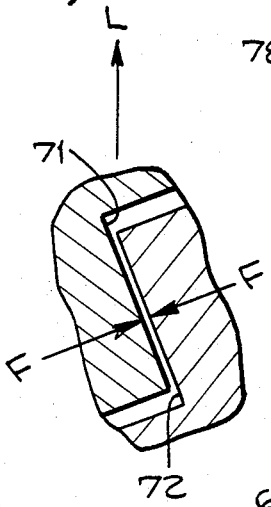

FIG. 13 is an enlarged fragmentary view of tension lock threads of the coupling of FIG. 12, the view being indicated by circular phantom line XIII of FIG. 12.

Figures 4, 14:
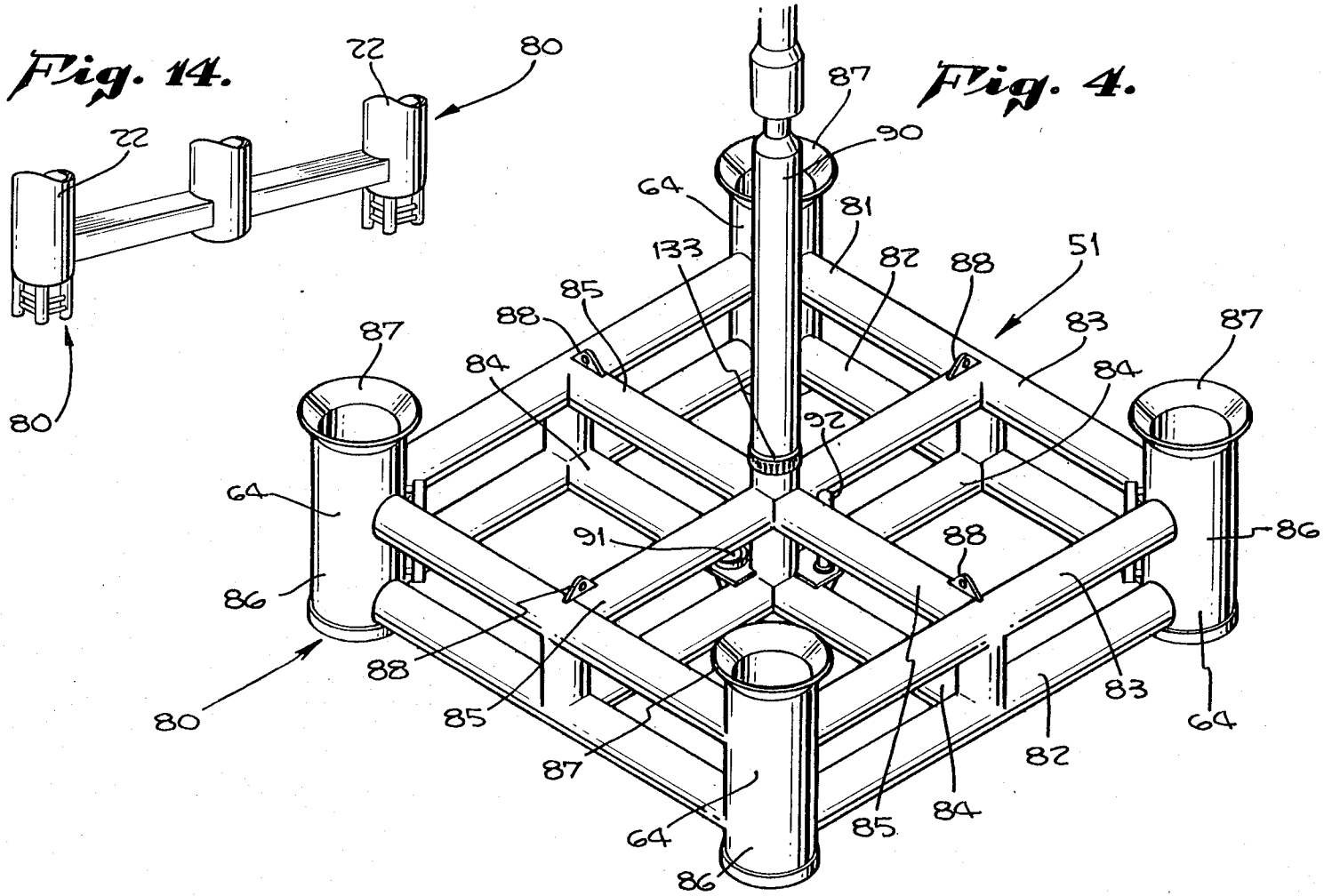
FIG. 4 is a perspective view of an anchor pile guide means employed in the conversion of the platform to a tension leg platform.

FIG. 14 is a fragmentary perspective view of a platform carrying anchor pile guide means of FIG. 4.

Figure 15:
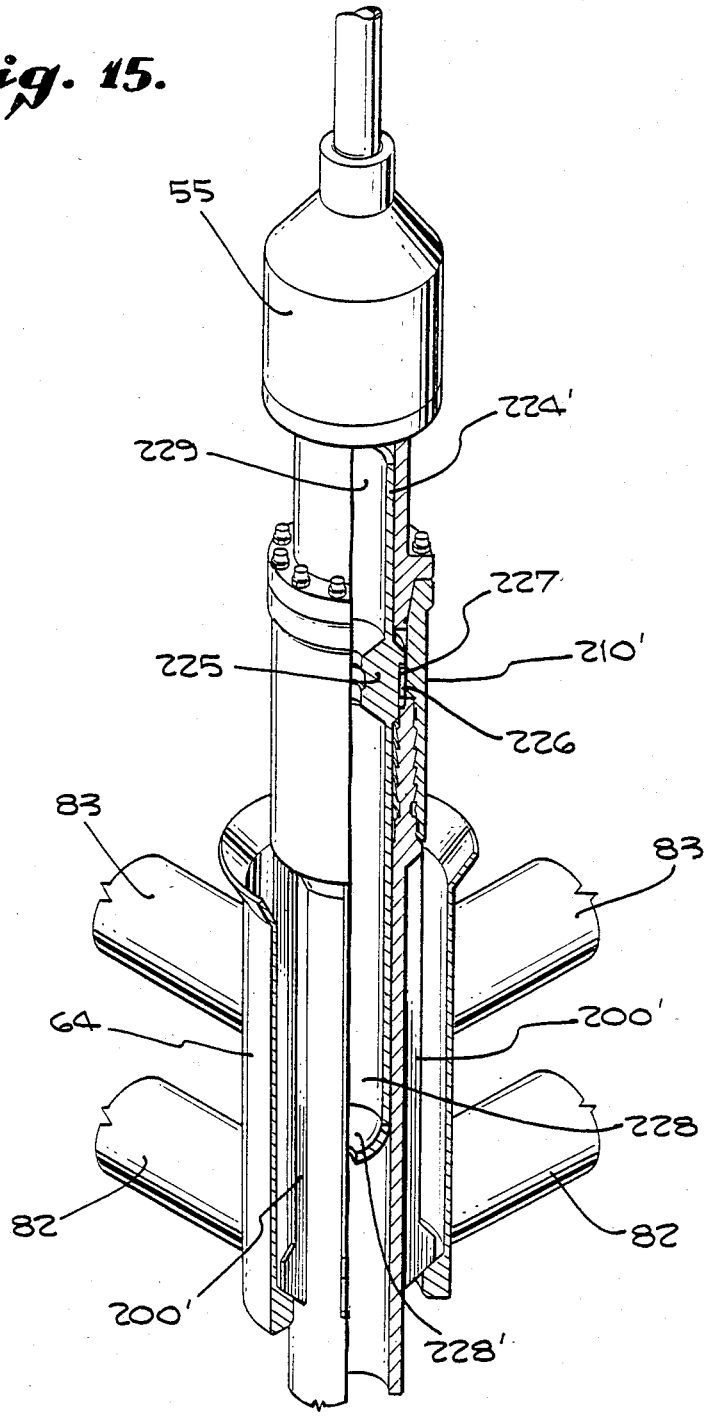

FIG. 15 is a perspective view of a modification of the anchor pile connector.

Figure 16:
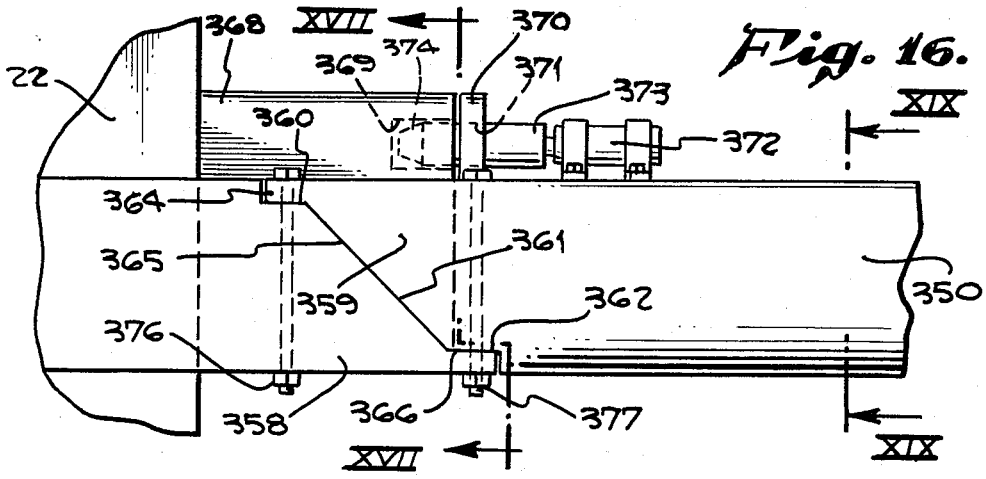

FIG. 16 is a fragmentary enlarged elevation view of the mounting means for one end of the mass trap means, the end indicated by a circle in phantom lines marked XVI.

Figure 17:
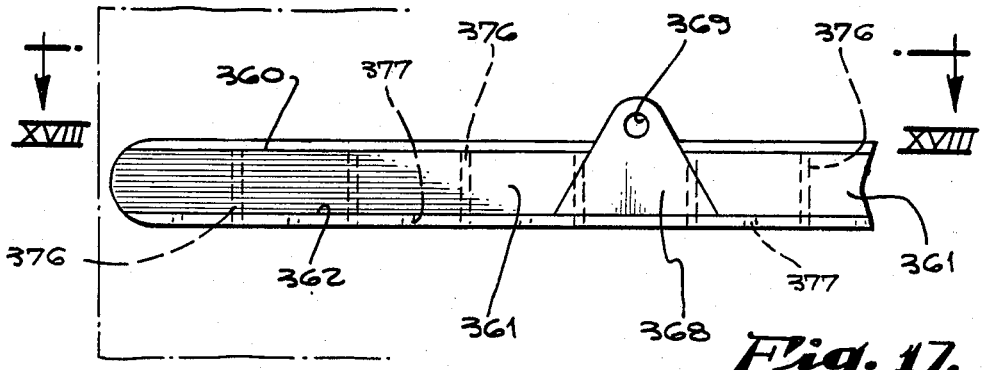

FIG. 17 is a fragmentary elevational view taken in the plane indicated by line XVII—XVII of FIG. 16, with the mass trap means removed.

Figure 18:
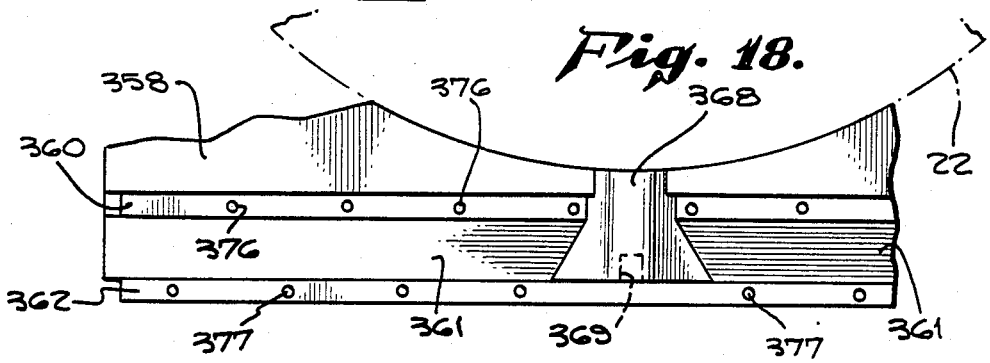

FIG. 18 is a fragmentary top view taken in the plane indicated by line XVIII—XVIII of FIG. 17.

Figure 1:
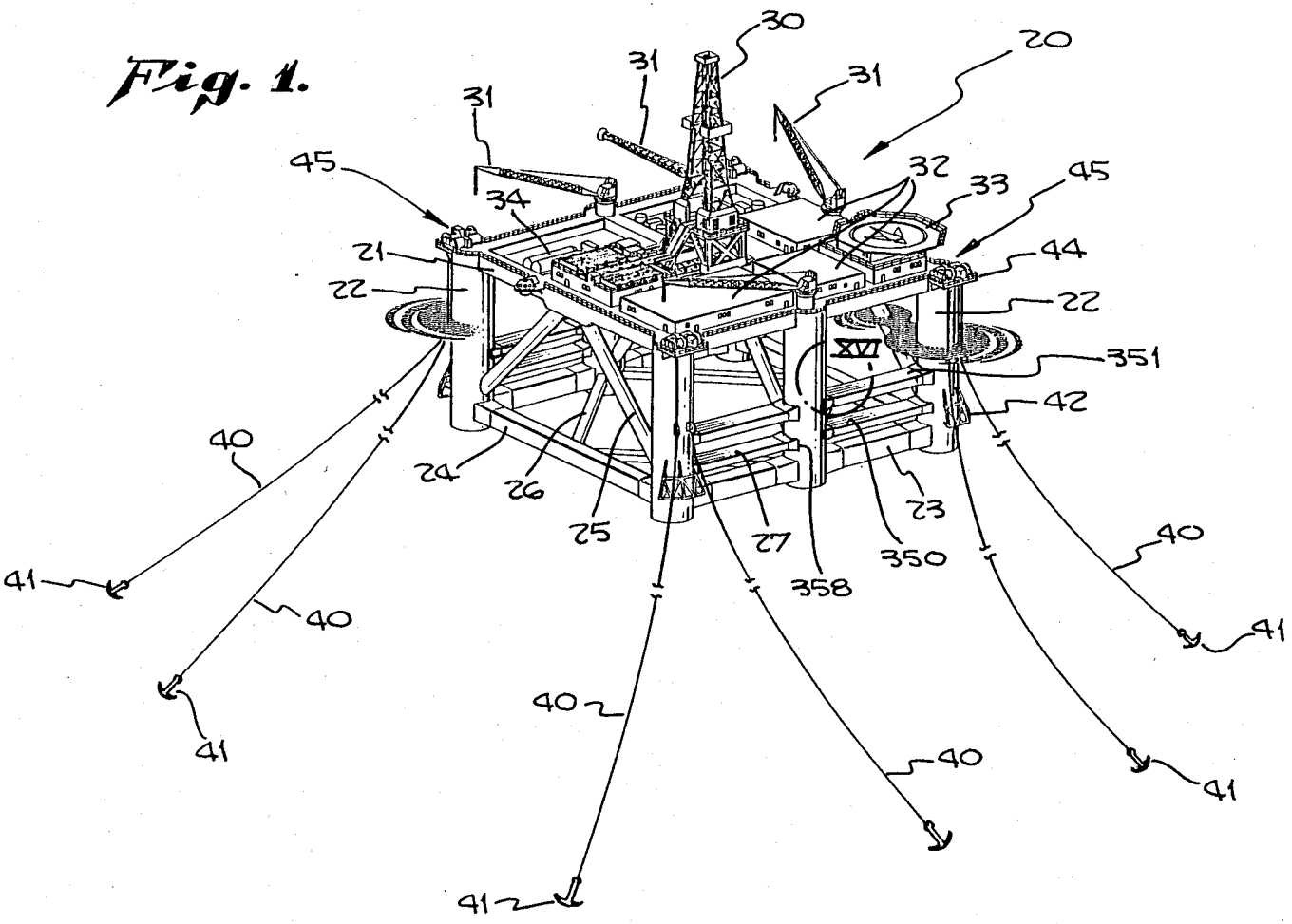
FIG. 1 is a perspective view of a mobile offshore platform embodying this invention in semisubmersible and catenary mooring.
Figure 19:
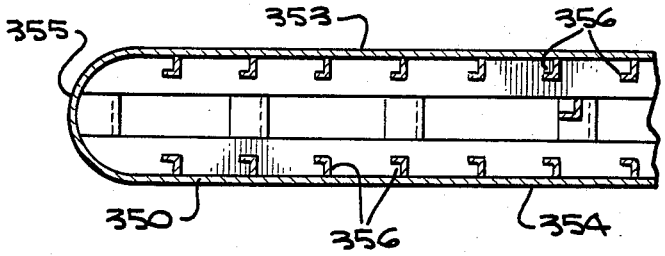

FIG. 19 is a fragmentary transverse sectional view taken in the plane indicated by line XIX—XIX of FIG. 1.

The present application discloses an entire system, method, and apparatus for conversion of a single platform from a semisubmersible floating platform structure useful for offshore exploration and exploratory drilling to a tension leg platform useful for production of hydrocarbons from one or more wells for a sustained or permanent time period. Several aspects of the system, particularly with respect to the structure of a tension leg means which is described herein, are described and claimed in copending applications hereinafter identified and such tension leg specific structures are not claimed herein.

In the example of the invention disclosed herein, an offshore, mobile, marine platform generally indicated at 20 is of rectangular form. It will be understood that the platform may be of other polygonal shapes, such as triangular, hexagonal, octagonal and the like. In FIG. 1, platform 20 generally comprises a platform deck 21, a plurality of buoyant vertical columnar members 22 arranged with three columnar members on each side of deck 21 and of selected diameter and height, and a plurality of horizontal buoyant members 23 interconnecting the columnar members along each side and horizontal end buoyant members 24 interconnecting corner columnar members 22 at ends of the rectangular platform. Suitable structural diagonal members 25 interconnect lower portions of corner vertical columnar members and the platform deck. In the planar zone of the horizontal buoyant members 23 and 24, internal diagonal structural horizontal members 26 brace the lower portion of the platform. In this example, horizontal bouyant members 23 and 24 are shown of rectangular cross sectional configuration, although it will be understood that oval or cylindrical configurations may be employed in certain platform designs.

The displacement ratio of the horizontal members 23, 24 with respect to the total displacement of the platform including horizontal and vertical buoyant members may be in the order of 0.30 to 0.60 percent as described in U.S. Pat. No. 3,780,685. It will be understood that other tension leg designs may be used such as disclosed in U.S. Pat. Nos. Re. (30,590), and (3,154,039).

In this example, platform deck 21, FIG. 1, carries various exploratory well drilling equipment including a suitable derrick 30 on the deck 21, a plurality of rotatably mounted cranes 31 located adjacent edges of the deck to facilitate handling of well equipment, suitable buildings 32 for housing certain supplies and personnel, a heliport 33 at one corner of the platform to accommodate landing and takeoff of helicopters, and supply and storage areas 34 for various equipment required in exploratory drilling and in production operations. This equipment is indicated in general only, it being understood that the type and amount of such equipment depends upon the operation for which the platform 20 is to be outfitted.

Figure 2:
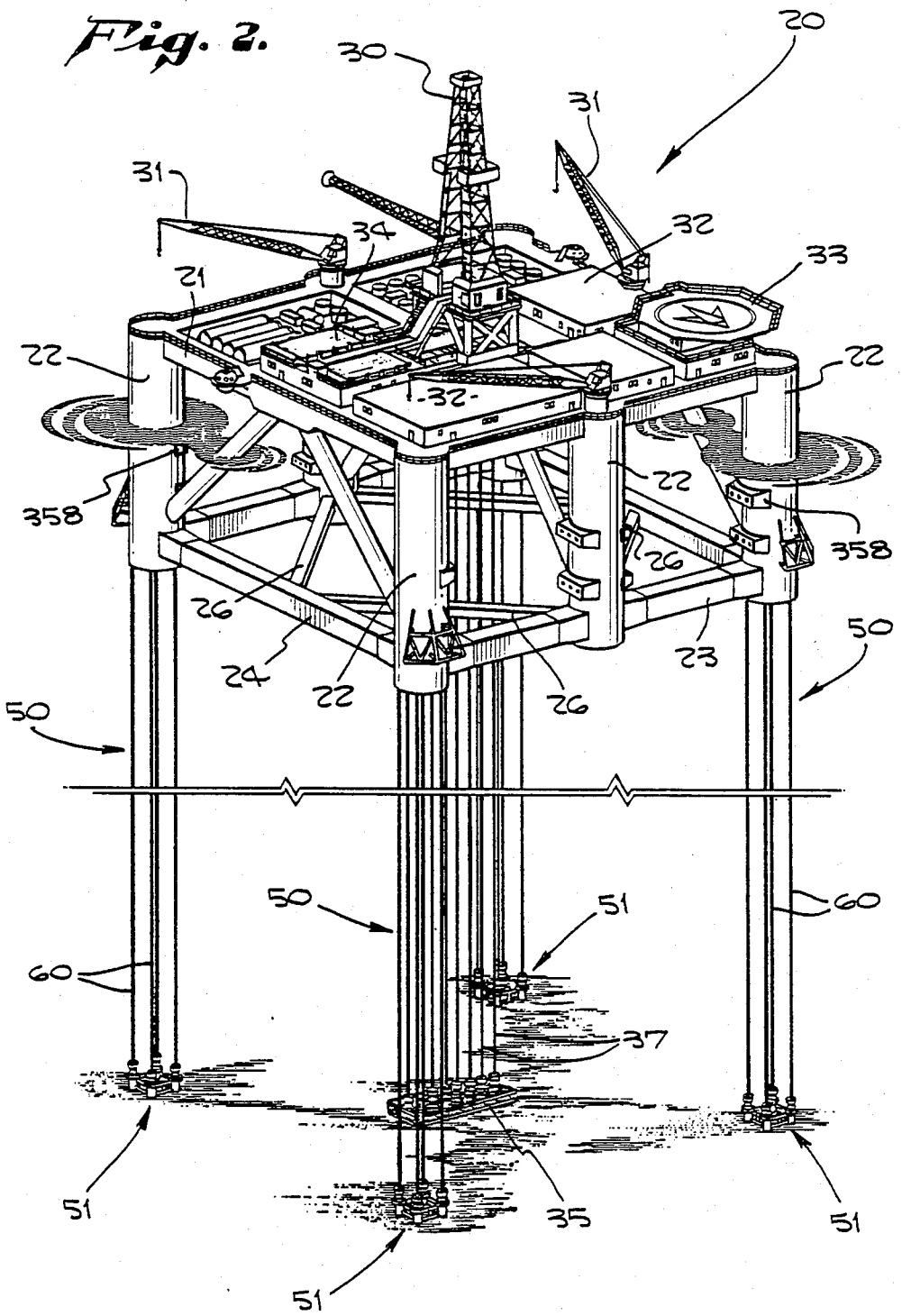
FIG. 2 is a perspective view of the platform shown in FIG. 1 in tension leg production mode.

Platform 20 is adapted to be anchored above a well site in both semisubmersible floating mode, moored by suitable catenary lines attached to temporary anchors, and is adapted later to be anchored in tension leg mode as illustrated in FIG. 2. In semisubmersible mode as shown in FIG. 1, catenary anchor lines 40 are attached to temporary anchors 41 schematically illustrated herein, it being understood that anchors 41 may be of other type than the ship's anchor shown. Mooring lines 40 may be guided through fairlead pulleys 43 located intermediate the height of each corner column member 22. Platform deck 21 is provided with an extension 44 projecting outwardly at each corner columnar member to support suitable mooring line winch means 45 for paying out and hauling in the mooring lines 40. Winch means 45 may be of well-known type and may be readily controlled to substantially equalize the tension on mooring lines 40 to hold platform 21 in a selected position over a well site and to also provide limited lateral displacement movement of the platform over the well site to accomplish exploratory drilling. Anchors 41 for catenary mooring may be set by an auxiliary vessel which picks up ann anchor 41 from the anchor rack 42. As the auxiliary vessel moves away from the platform, the winch line is payed out and anchors 41 may be readily lowered and engaged with the sea floor for positioning platform 20 as desired. Anchors 41 may also be readily retrieved from the sea floor in order to permit moving of platform 20 from a first selected well site to a second well site, either closely adjacent to or at some distance from the first well site.

In semisubmersible mode as illustrated in FIG. 1, platform 20 may be ballasted by introducing ballast (sea water) into vertical buoyant members 22 and into horizontal buoyant members 23, 24 to cause the platform to be positioned in the water with horizontal buoyant members 23, 24 at the bottom of the platform located at or just below the influence of expected wave action. In such low draft condition, horizontal members 23, 24 of rectangular section with flat plate area represented by the top horizontal plates or walls of the members 23, 24 provides a water mass trap effect which tends to reduce the vertical heave of the platform.

Each horizontal buoyant member 23 and 24 is provided a rectangular cross sectional area having an horizontal aspect ratio; that is, the ratio between width and height or depth, of about 3.0 or less. It will be understood that in an optimum tension leg platform design the horizontal aspect ratio of such a horizontal buoyant member may be 1.0 and preferably less as described in U.S. Pat. No. 3,577,946. It will also be understood that in an optimum semisubmersible platform design a large horizontal surface area is desired; and a rectangular cross sectional area horizontal aspect ratio may be in the order of 10.0 to infinity (theoretical) since the planar horizontal surface area is reactive against the volume of water above that surface area. Thus, in an optimum semisubmersible platform design, horizontal area is a significant factor. In an optimum tension leg platform design, such expansive horizontal reactive area on a horizontal member may tend to produce excessive cyclical tension loads on the tension legs of the platform and a horizontal member having less than 1 horizontal aspect ratio or minimal horizontal planar area is most desirable. Thus, in the design of the present platform which is adapted to be converted from semisubmersible mode to tension leg mode, a compromise has been made wherein the horizontal surface area of the horizontal buoyant member may provide an horizontal aspect ratio greater than 1, but not so substantially large an area that while tension loads on the tension legs are increased, such tension loads are within design parameters. In semisubmersible mode, it may be desirable that some virtual mass trap effect be provided by the horizontal buoyant members 23, 24 as indicated by the aspect ratio of 3. Such compromise in design facilitates the conversion of the platform from its semisubmersible mode to tension leg platform mode.

It will be understood that the displacement ratio of the horizontal members 23, 24 with respect to the total displacement of the platform including vertical buoyant members 22 may be in the order of that described in U.S. Pat. No. 3,780,685. Thus, the addition of virtual mass trap means at 27 located above the horizontal members 23, as shown in FIG. 1, will facilitate use of the platform as a semisubmersible and, upon removal or retrieval of the mass trap means 27, will permit the platform to function as a tension leg platform when under taut mooring.

Virtual mass trap means 27, in this example, may comprise horizontally extending plate-like members 350 and 351 spaced vertically apart a selected distance, for example, 30 feet, plate-like member 350 being spaced above horizontal buoyant member 23 a similar distance such as 30 feet. Plate-like members 350 and 351 extend between each end vertical column 22 and the intermediate vertical column 22. Means for releasably attaching each of the plate-like members 350 and 351 at each end to the adjacent vertical column 22 is substantially the same construction and for brevity only one end mounting will be described.

In FIG. 16, member 350 (and member 351) may comprise an elongated generally rectangular section having top and bottom walls 353 and 354 connected by end walls 355 and suitably reinforced as by internal reinforcing angle section members 356. The interior of each member 350, 351 is provided communication with ballasting means (not shown) for installation and retrieval purposes described hereafter.

At each end of member 350, mounting and securing means are provided for removably attaching the end to an adjacent column 22. In this example, each column 22 is provided with a mounting member 358 secured as by welding at 359 to cylindrical walls of column 22. Each mounting member 358 has a height or depth approximately the same as that of plate-like member 350 and provides landing surfaces for end portion 359 of a member 350. Such landing surfaces include a top recessed shoulder surface 360 from which downwardly and outwardly extends an inclined surface 361 which terminates in a flat lower landing surface 362 at the bottom portion of mounting member 358. Each end portion 359 of a member 350 or 351 includes a corresponding configuration providing a top flange 364, a downwardly inwardly inclined surface 365 which terminates in a downwardly facing bottom shoulder 366 adapted to seat on flange 362. Member 350 may be lowered and landed on opposed mounting members 358 carried by adjacent columns 22 and supported thereby.

Means for securing each end portion 359 to mounting member 358 includes a positioning block 368 secured to the top wall of mounting member 358 and providing a positioning hole 369 therein. End portion 359 of member 350 includes a positioning lug 370 provided with a bore 371 adapted to be aligned with bore 369 when end portion 359 is aligned and seated on mounting member 358. End portion 359 also carries a hydraulic cylinder 372 carrying a locking pin 373 having a conical end 374 for passage into and through bore 371 and into bore 369 for locking end portion 359 in landed and seated position on mounting member 358. After both ends of member 350 are locked to adjacent columns 22, a diver may further secure member 350 by nut and bolt assemblies 376 and 377, bolt assemblies 376 being located at the top flange 364 and extending through mounting member 358 and bolt assemblies 377 extending through end portion 359 and the bottom flange 362 on member 358.

Installation of plate-like members 350 and 351 may be readily accomplished in a shipyard by means of cranes. In installation of members 350, 351 at sea, the platform may be ballasted so that the lower mounting member 358 for member 350 is located about 10 feet below water surface. The member 350 may be floated between columns 22 and ballasted until member 350 is just positively buoyant. The member 350 may then be drawn downwardly by suitable winches and control ropes until member 350 lands on mounting members 358 and locking pins 373 and bores 369 are vertically aligned. The member 350 may then be ballasted to slightly negative buoyancy, and the locking pin hydraulically actuated to lock member 350 to the columns. This procedure may be repeated for installation of the other three lower members 350

Installation of the upper members 351 may be accomplished in similar manner except that the platform may be further ballasted until the upper mounting members 358 are about 10 feet below the water surface and the above procedure then followed with respect to locking and securing the upper members 351.

If desired, the bolts 376 and 377 may be installed by deballasting the platform until the lower members 350 are clear of the water.

When the platform is converted from semisubmersible mode to tension leg mode at sea, the virtual mass trap means 27 may be removed from their connection to columns 22 and retrieved. Preferably, such retrieval is accomplished during calm weather. In the retrieval operation, ballast control lines and hydraulic control lines are connected to the upper members 351, securing bolts 376 and 377 are removed and the locking pins 373 are hydraulically retracted for release of end portions 359 of members 351. Member 351 is gradually deballasted and lifted to the surface to one side of the platform. When member 351 has reached a position for sufficient towing freeboard, the member 351 may be towed away from the platform after disconnecting ballast control and hydraulic lines. This retrieval operation is repeated for each of the other three members 351.

The same process is repeated for the lower members 350, each lower member 350, after being released from mounting members 358 as above described, is moved laterally away from the platform to provide clearance from the mounting members 358 for the upper members 351. The lower members 350 are deballasted until they reach a towing position at the surface and may then be towed to a suitable destination.

It will thus be understood that the virtual mass trap means 27, together with the horizontal buoyant members 23, 24 will provide a platform adapted to operate as a semisubmersible and to be suitably moored in catenary fashion for exploratory drilling. When the platform is desired to be used in tension leg mode, retrieval of the mass trap means 27 and each of the members 350 and 351 modifies the hydrodynamic characteristics of the platform so that the platform may be utilized as a tension leg platform.

Virtual mass trap means 27 may include the utilization of horizontal flat plate-like members of different design and aspect ratio and may also include virtual mass trap constructions described and claimed in copending application Ser. No. 387,418 filed June 11, 1982.

In exploratory drilling in semisubmersible catenary moored mode, it will be understood that rig 30 and its drill string may be provided with heave compensation means of well-known manufacture, as well-known in the art of drilling from a semisubmersible.

When it is desired to move the platform to a different well site in the event the well site proved to be unproductive, the anchors 41 are readily retrieved, the platform deballasted to permit its movement through the water at a selected draft to facilitate such movement.

It should be noted that the horizontal buoyant members 23, 24 hereinabove described as being of rectangular section with relatively flat wide large horizontal surface areas to act as virtual mass trap means may include the invention disclosed in copending application, Ser. No. 387,418, in which similar horizontal buoyant members are arranged for 90 degree rotation about their longitudinal axis so as to present large horizontal flat plate areas for semisubmersible mode and reduced horizontal flat plate area for tension leg mode as hereinafter described.

Platform 20 is illustrated in tension leg mode in FIG. 2. Mass trap means 27 which provided means facilitating operation of the platform in semisubmersible mode have been removed, retrieved, rendered inoperable and for this reason are not shown in FIG. 2. The structure of platform 20 in FIG. 2 includes the equipment and features described in FIG. 1, except that the catenary mooring lines 40, temporary anchors 41 and winch means 45 have been retrieved and are inoperable for operation of the platform 20 in tension leg mode. Generally, each of the corner vertical buoyant columnar members 22 are now connected with tension leg means 50 provided with permanent anchor means 51 at the sea floor. The platform is shown as being located over a plurality of wells defined by a multiple well template 35 located on the sea floor and provided with wellhead means 36 and production lines or risers 37 extending to the platform deck and connected with the production equipment at the deck as schematically illustrated thereon, such production equipment being well-known. In tension leg mode with permanent anchors 51, the tension leg means 50 are arranged substantially parallel and are connected to the platform through the corner vertical columnar members 22 in a manner hereafter described. In tension leg mode, platform 20 is positioned at a selected draft in the water in which the vertical columnar buoyant members 22 and horizontal buoyant members 23 and 24 are in the sphere of expected wave action so that vertical forces acting on the platform are substantially neutralized or offset and the platform is not subject to heave, pitch or roll as described in U.S. Pat. No. 3,780,685.

TENSION LEG MEANS

Figure 3:
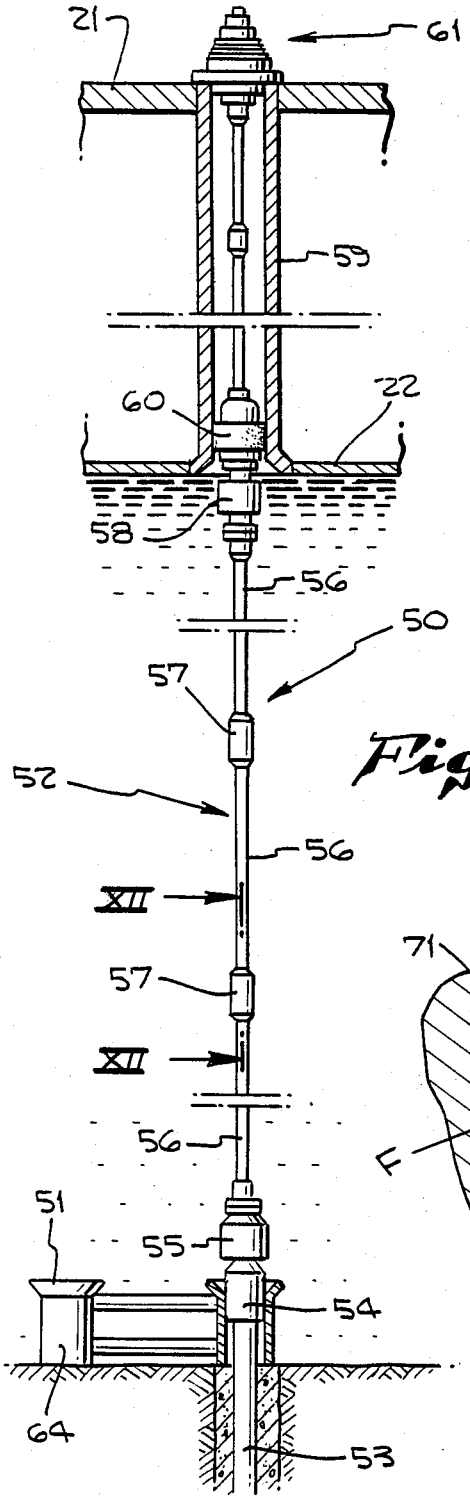
FIG. 3 is a schematic elevation view, partly in section, of a tension leg means platform hawse pipe, and anchor means.

Generally, each tension leg means 50 may comprise one or more tension members, such as interconnected sections of pipe, or elongate members adapted to be placed under tensional stress. For purposes or brevity in the description and clarity in the drawings only one tension string 52 is shown in FIG. 3. Each tension leg means 50 may include a plurality of tension pipe strings 52, in this example, four strings. Each string 52 may generally comprise a pile member 53, a pile connector means 54, a bottom flexible joint 55, a plurality of pipe string members 56 interconnected by coupling members 57, an upper flexible joint 58 just beneath the lower end of hawse pipe 59 carried in columnar member 22, a tension member stabilizer 60 engageable with the lower interior end of the hawse pipe 59, and quick latch means 61 at the platform deck 21 for securement of the top end of the tension string 52 to the platform. Each tension string 52 (FIG. 3) is adapted at its lower end to be connected to a pile member 53 permanently secured as by cementing in the seabed. At its upper end, each tension string 52 passes through a hawse pipe 59 provided in columnar vertical member 22. The upper end of tension string 52 is connected to latch means 61 which is landed on and secured to the top deck portion 21 at the top of vertical columnar member 22. Vertical columnar member 22 is of sufficient diameter to include four equally radially spaced hawse pipes 59 for accommodating the three other tension strings 52. The number of and generally the spacing of the hawse pipes 59 in the columnar member 22 corresponds to the spacing of anchor pile guide conductor members 64.

Each tubular pipe member or section 56 is of suitable length, diameter and metal wall section. Adjacent ends of pipe section 56 are preferably coupled together by a coupling member 57, the coupling member and the ends of pipe section 56 received therein being provided with coarse buttress tension lock thread means indicated at 68. Tension lock thread means 68 comprises cooperable pin threads 69 and box section threads 70 which have a relatively flat seizing taper of about 30° or less to permit coupling with low or minimum torque makeup and breakout, but having high resistance to backoff or unthreading under tension loads. It will be apparent from FIG. 13 that under a tension load applied in the direction of arrow L and transmitted between box threads 70 and pin threads 69 that thread surface 71 and mating thread surface 72 are at an angle to the direction of the load force sufficient that forces F result in large normal friction forces which will resist such backing off under load.

Coupling member 57 is provided with an annular interior groove 74 adjacent each end to accommodate a seal member 75 which bears against a tapered flat surface 76 at the end of the threaded section remote from the end of the pipe section. Coupling member 57 is also provided with annular interior grooves 77 for receiving a seal member 78 at the central section of the coupling member 57 for engagement of the seal members 78 with the conical surface 79 at the end of the threaded section. The seal members 75 and 78 resist introduction of sea water between the threads and assists in maintaining the threads in condition for disassembly and maintenance of the tension string when required.

ANCHOR PILE GUIDE MEANS

In this example, anchor means 51 for tension leg means 50 may comprise an anchor pile guide means generally indicated at 80 in FIG. 4. Guide means 80 may comprise a polygonal or square frame means 81 comprising parallel vertically spaced peripheral members 82 and 83 interconnected by internal top and bottom parallel members 84 and 85 arranged at 90° and forming a cross interconnecting mid points of peripheral members 82, 83, respectively. At corners of square frame means 81 may be provided cylindrical guide conductors 64 provided with upwardly, outwardly flaring top portions 87 to facilitate guiding of an anchor pile member 53 through conductor 64. Frame means 81 may be provided with cleats 88 at mid points of top side members 83 to facilitate handling of the guide means 80. Secured at the intersection of crossing internal members 84, 85 is provided a central guide post 90 having means to connect a single guide line thereto.

Adjacent the bottom portion of guide post 90 may be provided a level indicator 91 of suitable make, as for example, a "bulls eye" type, and adapted to be monitored by underwater television means, so that anchor pile guide means 51 may be installed on the sea floor in a level or horizontal position. Installation of the anchor guide means 51 in level position assures that the axes of the conductors which may comprise a float bubble are vertical and in desired position for the anchor pile drilling operation.

Also, adjacent the bottom portion of guide post 90 is a signal sending device 92 or pinger which facilitates locating anchor means 51 at great depths in water by use of well-known sonar systems.

As illustrated in FIG. 2, each of the anchor pile guide means 51 are adapted to be located vertically beneath corner columnar members 22 of the platform. In one example each anchor guide means 80 may be suitably releasably secured to the bottom end of a platform vertical column 22 for transporting and carrying of the anchor guide means 80 during movement of the platform to a well site and during exploratory drilling while the platform may be operated in semisubmersible catenary moored mode. When it is determined that the well site is to be produced and with the platform in selected position over the well site, each of the anchor means 80 may be released from the bottom of its associated column member 22 and lowered to the sea floor by means of drill pipe. Thus, when the anchor guide means 80 is positioned on the sea floor and is ready for installation of the anchor piles 53 through the guide conductors 64, the center post 90 provides a means for connection of a single guide line to anchor means 51 for guiding tools for drilling of holes in the sea floor for the anchor pile members 53.

TENSION LEG MEANS INSTALLATION UNIT

While the anchor pile guide means 51 are being lowered and set on the sea floor, a tension member installation unit generally indicated at 100, FIG. 11, may be suitably mounted on the deck over the top portion of a vertical columnar member 22. In FIG. 11, unit 100 comprises a derrick generally indicated at 101 including vertical columns 102 suitably braced and supporting a top deck 103, an intermediate deck 104 and a lower working deck 105. Within the arrangement of four columns 102 may be supported a hydraulic hoist means 106 extending upwardly from the lower deck 105. The hydraulic hoist means is connected with a pair of top pulleys 107 reaved with pulleys 108 on the hydraulic hoist 106 by lines 109. Lines 109 are connected to a travelling yoke 110 provided with a stroking elevator 111 and a rotatable pipe spinner.

A hydraulic operated bushing 112 serves to support the pipe string when threading of a next pipe joint during running in of the pipe string. The travelling yoke and pipe spinner are vertically guided along two of columns 102 and are adapted to pick up and hold pipe sections 56 for introduction of the lower end of the pipe section into one of the four hawse pipes 59 provided in columnar member 22.

Unit 100 may be mounted on the platform deck at the columnar member for rotation about the axis of the columnar member 22 so that travelling yoke 110 may be readily selectively positioned over each of the four hawse pipes provided in a columnar member 22 and each hawse pipe oriented with an anchor pile guide conductors 64 at the sea floor by positioning of the platform. The rotation of unit 100 may be provided by a circular track 115 having a plurality of circumferentially spaced ratchet holes 116. The lower deck 105 may be provided with downwardly extending support members 118 which carry shoes 119 slidable on circular track 115. A hydraulic jack means 120 at each of the support members 118 is engageable with holes 116 so that unit 100 may be rotated through 90 degrees to the next hawse pipe in columnar member 22 and precisely incrementally indexed with respect thereto by jack means 120.

A pivoted derrick arm 122 is carried by one of the columns 102 at the top deck 103 for facilitating handling of the tension pipe sections 56 stored in the rack therefor at intermediate deck 104. A console 123 is provided for controlling the several operations required in installing and connecting the tension pipe sections 56. Suitable power equipment 124 is also provided on the lower deck to provide the necessary electrical, hydraulic, and pneumatic systems required for operating the unit 100.

Main hoisting cylinder 106 may be operated as a heave compensator and, for example, during the transition from catenary moored mode to tension moored mode as later described.

ARTICULATED GUIDANCE MEANS

An articulated rotatable and retractable guide structure generally indicated at 130, FIG. 5, is associated with center guide post 90 of the pile member guide means 51 and provides guidance means for installing anchor pile members 53 at each of guide conductors 64. Guide structure 130 includes a cylindrical member 131 adapted to be received over guide post 90 in concentric relation and rotatable about the axis of post 90 for positioning adjustable retractable laterally extending guide arms 132 in registration with an anchor pile guide conductor 64. Means for controlling such indexing and registration is provided by an annular rack member 133 provided on center guide post 90 adjacent the intersection of cross members 85 of the guide means 51. The annular rack member 133 may be provided with a plurality of circumferentially spaced recesses 134 engaged by a hydraulically actuated positioning jack 135 having a pawl 136 engageable with recesses 134 for incrementally rotating the guide structure. The cylindrical member 131 may have a bottom landing surface cooperable with a landing surface on the center column of the guide means 51 to vertically position jack 135 for registration with the rack 133. Means for controlling jack 135 will be described hereafter.

Retractable arms 132 of guide structure 130 include a base arm portion 137 having a pivotal mounting at **137*a* on trunnions 137*b* carried by cylindrical member 131. Base arm portion 137 at the pivotal mounting 137*a* may be of generally triangular shape, the upper portion 138 providing a pivotal connection at 139 with a transverse shaft 140 pivotally connected to a piston rod 141 of a cylinder means 142 pivotally connected at 142*a* to member 131 for rotation of the arm means 132 about axis 137*a* into an upwardly folded position generally parallel to cylindrical member 131 as shown FIG. 5*a***.

Arm means 132 includes square cross section hollow portion 143 integral with base portions 137 and adapted to slidably telescopically receive therewithin outer square section arm portions 144. At their outer ends, arm portions 144 carry a transverse registration plate 145 having a convex outer edge 146 of generally the same curvature as the outer circumference of the conductor 64. Outer arm portions 144 may be moved into the square section portions 143 by piston and cylinder means 148 carried therewithin so as to retract the outer arm portions 144 therewithin and plate 145 to allow turning of the guide structure to an adjacent guide conductor 64 or for pivotally lifting by cylinder means 142 the collapsed arms 144, 143 when it is desired to rotate the structure about axis **137*a* to position the arms adjacent to and approximately parallel with the cylindrical member 131 for lowering or retrieving the articulated guide structure 130**.

It will be noted that registration plate 145, together with the outer ends of arm portions 144 provide means for positioning the pair of guide lines 147 in approximately diametrically opposite relation to the axis of the guide conductor 64. Guide lines 47 may serve to facilitate guiding of drill pipe and suitable tools in coaxial relation with conductor 64 for the preparation of holes in the sea floor for pile members 53, and for guiding pile members into conductor 64.

It will thus be readily apparent that after the anchor pile guide means 51 has been located on the sea floor vertically directly beneath a column 22 and conductors 64 oriented with respect to corresponding hawse pipes in column 22, the articulate guide structure 130 may be readily lowered and indexed onto the anchor guide means 51 with arm means 132 and guide lines 147 in registration with a guide conductor 64 for drilling of the holes in the sea floor for the anchor pile members.

ARTICULATED GUIDE STRUCTURE CONTROL POD

Means for controlling indexing and positioning of the articulate guide structure 130, during the drilling of the pile member holes, installation of the pile members therein at each conductor lowered and indexed, and for lowering and retrieving guide structure 130 may comprise a control pod 152 (FIGS. 5 and 6). Pod 152 includes an outer cylindrical body member 153 having a bottom open end 154. Body member 153 may be divided into an upper compartment 155 and a lower compartment 156 separated by a transverse bulkhead or wall 157. Upper chamber 155 includes a coaxial cylindrical tube 158 for guidance on a single guide line 159 connected with guide post 90 of the pile guide means 51. Upper chamber 155 also houses a lower coupling 160 of an electrical and hydraulic control line bundle 161 which extends through a sealed port 162 in the conical end wall 163 of body member 153. A guide collar 164 permits free passage of guide line 159 into tube 158 during lowering or raising of the control pod assembly.

Lower chamber 156 is provided with an internal cylindrical body element 166 secured to wall 157 by support plates 167 as by welding to internal body element 166 and wall 157. Body element 166 has an internal landing surface 168 corresponding with the top conical configuration of member 131 and to be landed thereon in assembly of the pod 152 with the articulated guide structure 130. The bottom edge portions of body member 153 and body element 166 in landed position are in vertical spaced relation to annular flange 170 carried by cylindrical member 131.

Means for angular orientation of the pod 152 with cylindrical member 131 may comprise a helical cam surface 171 on member 131 lying in a plane at an angle to the axis of member 131, the lower end of cam surface 171 being provided with a downward extending recess 172 for reception of an internal cam lug (not shown) on cylindrical body element 166 adjacent the bottom end of element 166. When pod 152 is lowered, the cam lug engages the cam surface 171 and during lowering rotates pod 152 until the lug engages recess 172 to precisely orient pod 152 in landed position with respect to the cylindrical member 131.

Such angular orientation of pod 152 facilitates coupling of interior hydraulic fluid pressure lines such as 174 (exemplary) which is connected to umbilical coupling 160 and provides a hydraulic coupling to line 175 which may lead to and operate indexing jack means 135, or the cylinder means 141, or the cylinder means 148 for operation of the articulated guide structure. Line 174 extends through a segmental flange 176 provided on cylindrical element 166 just above the bottom end thereof. Coupling 177 connected to line 174 is biased downwardly by a spring 178 so that when the pod 152 drops into its final location as indicated by recess 172, the spring 178 is compressed and coupling 177 is urged into tight fluid sealed relation with its mating coupling element 179 of line 175 which extends through flange 170 on member 131. Only one such coupling arrangement is illustrated for purposes of brevity, it being understood that lines for other fluid operable systems may be similarly automatically coupled for fluid or electrical communication upon such lowering of pod 152.

Means for locking pod 152 to articulated guide structure 130 may include one or more latch dogs 180 in circumferential spaced relation about the internal cylindrical element 166 and extending through aligned ports 181 therein. Latch dogs 180 may be pivoted at 182 to a yoke carried by the upper end of a piston rod 183 of a fluid cylinder means 184 pivotally connected at 185 to a bracket 186 carried by the bottom portion of cylindrical element 166. The location of latch dogs 180 is predetermined so that when the pod 152 is landed in angular orientation with member 131, actuation of latch dogs 180 will cause their engagement with an annular latch groove 187 provided at the top end of cylindrical member 131.

Although not shown in the drawings the outer body member 153, tube 158, and cylindrical elememt 166 of control pod 152 are provided with a longitudinally extending through slot in a vertical axial plane for permitting the pod 152 to be assembled in concentric relation with the single guide line 159 and to slidably move therealong during lowering and raising. The collar 164 may be a split collar readily attached to the top of the pod 152 during assembly of the pod with line 159. It will be noted that by this arrangement of pod 152 with the single guide line 159, the umbilical line 161 may be loosely associated with guide line 159 for restraining umbilical line 161 from trailing or separation from the line 159 because of the ocean currents.

The transverse wall 157 may be provided with external flange extensions 190 which may carry a peripheral ring track 191 for mounting thereon of a slidable carrier 192 for supporting a vertically adjustable rod 193 carrying at its lower end a TV camera 194 and light means 195. Carrier 192 is adapted to be moved around the ring track 191 by suitable power means (not shown) for changing the location of TV camera 194 and and light means 195 so that the installation of pile members in each of the four corner conductors 64 may be readily observed at the platform. Means for controlling the position of the camera, light means, and rotational position of the carrier 192 are not shown since such as well known in the art.

It will be readily apparent that control pod 152 provides control means for operation of articulated guide means 130 and that the control pod may be readily retrieved by unlatching latch dogs 180 and raising the control pod 152 and causing separation of the coupling numbers 177 and 179. Retrieval of the control pod frees the guide line 159 for lowering a suitable running tool for raising articulated guide structure 130 to permit its operation at another anchor pile guide means 51 beneath another column 22 of the platform.

ANCHOR PILE CONNECTOR

In FIGS. 7 and 8, is shown one example of an anchor pile connector means 54. Anchor pile member 53 is provided at its top end with longitudinally extending parallel angularly spaced ribs 200 for guiding reception within conductor 64. The lower end of each rib 200 may be provided with a tapered face 201 landed on an internal annular tapered landing surface 202 provided on conductor 64. FIG. 7 also illustrates another system for landing anchor pile member 53 on conductor 64 as shown by a landing surface 202' engageable with a landing edge 201' adjacent frame member 83. The upper portion of each rib 200 may be provided with a stepped cutout 204 adapted to receive a split ring 205 for reception in cutouts 204 and an annular groove 206 in conductor 64 to further interlock the upper end of pile member 53 with the conductor 64.

The upper end of pile member 53 is provided with external tension lock threads 207 and also with auxillary back up or stand-by internal threads 208 for use in landing the pile member in the conductor 64. A pile connector coupling 210 is provided with internal tension lock threads 211 for engagement with external threads 207 when the lower end of the tension member is connected to the pile member 53. Tension lock threads 211, 207 provide a mechanical coupling connection adapted for remote engagement and breakout with low torque and are resistant to cross threading. Coupling member 210 also includes internal annular seal means 212 and 213 for engagement with the upper end of pile member 53. The upper end of coupling member 210 is provided with a flange connection with suitable securing bolts 214 to a connector member 215 of a flexible joint 55.

In this example, means for locking coupling member 210 against rotation on the threads 207 of pile member 53 is provided by a lock ring 217 carried within the upper internally thickened portion 218 of coupling member 210 and normally biased downwardly by a plurality of springs 219 circumferentially spaced about the top edge face of ring 217. Ring 217 is provided limited vertical movement by vertically elongated diametrical slots 220 in which are received for sliding engagement pins 211 carried by upper portion 218. The pin and slot arrangement 220 and 221 prevents relative rotation of ring 217 with respect to coupling member 210. Lock ring 217 carries at its outer circumference a pair of diametrically opposite lock keys 222 each of which extends below the bottom edge of ring 217 and are adapted to engage lock key recesses 223 provided in the internal surface of the upper end of pile member 53. It will thus be apparent that when the coupling member 210 is threadedly engaged with the threads 207 and rotated about the pile member 53 that the bottom edge faces of lock keys 222 will engage the top edge face 224 of pile member 53 until the springs 219 are compressed providing full threaded engagement of threads 207, 211 at which time the lock keys will be spring biased into the key recesses 223 during the last turn of rotation of coupling member 210. In such a locked condition, relative movement between the coupling member 210 and the top portion of pile member 53 is prevented. Further, the threads 211 and 207 are of a type to resist unthreading under tension loads.

When it is desired to release the lower end of the tension member from the pile member 53, a release tool may be lowered through the tension member string and through the lock ring 217, and then expanded so as to permit the lock ring to be raised against the pressure of springs 219 to disengage the lower ends of lock keys 222 from the key recesses 223. In such raised position of the lock ring 217 and upon a relaxation of the tension load, the coupling member 210 may be unthreaded and and the tension leg disconnected from the anchor means.

It will be understood that other examples of a lock system for a coupling member 210 for a pile connector may be provided. In place of a biased lock ring 217, an internal elongated tubular lock member 224', FIG. 15 may be assembled within coupling member 210' and will enter into the upper portion of pile member 53 as it is threaded together. Tubular lock member 224 has an enlarged thickened section 225 in spaced relation to its top end, the metal section 225 being provided with a longitudinally extending external key rib 226 adapted to be lowered into engagement with an internal longitudinally extending recess 227 provided on internal surfaces of coupling member 210' and pile member 53 to provide a key lock arrangement between the members 210', 224 and 53.

Lock member 224 includes a relatively long lower tubular portion 228 below section 225 and a relatively short upper tubular portion 229 above section 225. Portions 228 and 229 facilitate axial alignment of the bottom of the tension leg string during installation. When coupling member 210', lock member 224, and flex joint 55 are lowered to threadedly engage the pile member 53, the flex joint 55 may allow some axial misalignment of coupling member 210' with the pile member. Lower portion 228 of lock member 224 has a rounded bottom end 228' which facilitates leading portion 228 into the pile member. As downward movement continues, portion 228 brings coupling member 210' into axial alignment to permit threaded engagement to begin and to continue upon rotation of the tension spring. Upon reaching full threaded engagement, the lock member key rib 226 drops into recess 227 to lock the members 210', 224, and 53 against relative rotation.

Disconnection of the tension string from the pile member may be accomplished as in the prior example; that is, by raising member 224 to withdraw key rib 226 from recess 227 and then unthreading coupling member 210'. This may be readily achieved by using a conventional internal engaging tool such as a tubing or casing spear or a wireline supported latching tool.

FLEXIBLE JOINTS

Each tension string is provided with a flex joint 55 at its lower end and a flexible joint 58 at its upper end as previously generally described. These flexible joints permit angular movement of the axis of the tension member with respect to the fixed axis of the anchor pile connector 54 and with respect to the hawse pipe 59 without imparting substantial bending stress to the tension member as the platform undergoes offset and oscillatory motion in response to wind, wave and current in the ocean environment. Such flexible joints are of well-known make and manufacture, such as the Lockseal coupling manufactured by Murdock Machine and Engineering Company of Texas.

TENSION MEMBER STABILIZER MEANS

In FIG. 9, stabilizer means 60 for each tension string 52 is shown at the lower open end of hawse pipe 59 carried in a column 22 of the platform. Stabilizer means 60 is located at or adjacent to the upper flexible joint means 58 and generally serves to transmit any lateral or horizontal components of the mooring forces to the tension leg platform in a nondestructive manner. Stabilizer means 60 is connected in suitable manner to the upper end of flexible joint means 58 and also to the lower end of a pipe section 56 extending above the stabilizer means.

Stabilizer means 60 includes a circular base member 230 positioned just within the botton opening 231 of hawse pipe 59. Seated on base member 230 is an annular radially expandable rubber or neoprene member 232 of selected height and diameter and when subjected to compressive forces is arranged to flow radially outwardly for engagement as at 233 with the interior cylindrical surfaces of the lower end of hawse pipe 59. The lower end of hawse pipe 59 may be provided with a thickened section of metal as at 234.

Means for applying vertical compressive forces to the expandable rubber member 232 may include a plurality of circumferentially spaced piston and cylinder means 235. The lower end of cylinder means 235 may be pivotally connected at 236 to a bracket 237 carried on a pressure ring 238 adapted to seat on the top surface of expandable rubber means 232. Each piston and cylinder means 235 includes a piston 239 and cylinder means 240 thereof may be pivotally connected at 241 to a bracket 242 on a cylindrical collar 243. Collar 243 may be spaced from pressure ring 238 by spacer member 244 and a slightly diametrically enlarged lower cylindrical spacer member 245 which provides a cylindrical guide member for pressure ring 238. Above collar 243 is provided a suitable cylindrical fitting 247 provided with a plurality of passageways (not shown) for fluid connection and communication with fluid pressure lines 248 connected at their upper ends on the platform deck with a source of pressure fluid. The piston and cylinder means 235, pressure ring 238, and collar 243 may be enclosed within a canopy 249 of less diameter than the interior diameter of hawse pipe 59.

When fluid pressure is introduced through lines 248 to the piston and cylinder means 235, the pressure ring 238 is moved downwardly under substantially uniform annular pressure and will serve to circumferentially evenly compress the expandable rubber member 232 against base member 230 to cause the outer circumferential surface **232*a* thereof to resiliently frictionally engage the interior surface of the hawse pipe. Expansion of member 232 radially outwardly into frictional engagement with the internal surfaces of the hawse pipe yieldably resists and cushion the lateral component of any tension forces transmitted through the tension leg string when platform 22 is laterally displaced from its vertical position over its anchor means 51. The resilient frictional engagement of member 232 with the interior surface of the hawse pipe also accommodates slight vertical oscillatory motion resulting from cyclical tension member loads by flexure of member 232, rather than sliding contact which would cause wear. Thus, virtually only vertical tension forces will be transmitted from the tension string through the tension string portion in the hawse pipe to the tension string quick latch means 61 shown in FIG. 10**.

TENSION STRING QUICK LATCH MEANS

In FIG. 10, quick latch means 61 is illustrated as landed on top deck 21 of the platform at the top opening of hawse pipe 59. Tension string 52 has been made up to its selected length and the top end of the tension string is indicated at 250. Quick latch means 61 is adapted to be sleeved over the top end portion 250 and lowered into centralized landing engagement as at 251 with the top deck 21.

Quick latch means 61 comprises a generally cylindrical latch body member 252 having a radial inner downwardly directed body wall portion 253, a horizontal radially outwardly extending wall portion 254 extending from the top of portion 253, and a radial outer upwardly extending cylindrical wall portion 255. Bottom portion 253 may be reinforced with a plurality of circumferentially spaced gusset ribs 256 having downwardly and inwardly inclined edge surfaces 257 for guiding and centralizing body member 252 in the top opening 258 of hawse pipe 59. The upper end of a top tension pipe section 56 may be provided with an enlarged cylindrical portion 260, the inner diameter of bottom portion 253 being greater than the outer diameter of top portion 260 to provide an annular space 261 into which may be received lower cylindrical end portions of skirt 262 of a piston member 263. Space 261 may be suitably sealed against introduction of foreign matter therein by an accordion type elongated seal member 264. The outer cylindrical wall portion 252, horizontal wall portion 254, and piston member 263 define a fluid pressure chamber 266 for introduction of pressure fluid. In FIG. 10, piston member 263 is shown in upper latch actuated closed position.

As mentioned above, latch body member 255 is landed at 251 on circumferential edge margins of deck 21 at opening 258 of the hawse pipe 59. Body member 252 may be secured in landed position by an upstanding circular wall 267 having at circumferentially spaced intervals a plurality of hydraulically actuated lock pins 268. Lock pins 268 when actuated to locking position as shown in FIG. 10 extend locking pins 269 into an annular outwardly facing groove 270 provided in the outer body wall portion 255. The annular groove 270 is provided with spaced stops 271 to contact locking pins 269 to limit rotation of the quick latch body member 252 with respect to circular wall 267. Thus when the latch means 61 is landed on the deck 21 in centralized position with respect to hawse pipe 59 the lock pins 268 may be actuated by suitable fluid actuating means (not shown) for retaining the body member 252 in landed position and connected to the platform.

Piston member 263 includes an inner cylindrical wall 272 of relatively thick section compared to the depending skirt 266. Wall 272 merges with a top radially outwardly extending flange 273 provided with an upstanding circular wall 274 also provided with a plurality of circumferentially spaced hydraulically actuated lock pins 275. Flange 273 is connected with piston wall 263 by a plurality of circumferentially spaced vertical reinforcing webs 276. Piston member 263 is held against rotation within body member 252 by a plurality of circumferentially arranged cleats 277 bolted to the top portion of wall 255 by suitable bolts 278. Cleats 277 are provided with inner notched edges as at 280 to receive and engage outer edge portions of webs 276 to limit relative rotational movement. A suitable annular accordion type cover 281 may enclose space between flange 273 and the upper edge of wall portion 255.

The inner peripheral upper edge of piston wall 272 may be suitably annularly relieved as at 282 for seating and engaging receivably a corresponding shaped inner portion of annular wedge actuator member 283. Wedge member 283 is seated as at 284 on the top inner peripheral surface of flange 273 interiorly of upstanding wall 274. Wedge actuator means 283 includes an annular groove 285 for reception of the pins of hydraulically actuated pin means 275 for a purpose later described.

Wedge actuator member 283 provides an upright flared seat 287 for a ring or plurality of slip elements 288 having slip teeth 289 for engagement with complementary teeth 290 provided on the upper end portion of the tension string. The seat 287 has a selected taper or wedge angle for moving slips 288 laterally into and out of engagement with the slip teeth 290.

Slip elements 288 are retained in engagement with the wedge actuator means 283 and are slidably connected by a top cap 295 having a radially inwardly extending top wall 296 having a bottom surface in engagement with the top surface 297 of slips 288. Top wall 296 may be provided with a radially extending shouldered slot **296*a* receiving a headed bolt 288*a* threaded into the top portion of a slip element 288 to support and guide radial movement of slip element 288. Cap 295 includes an outer wall 298 depending from top wall 296 and having an inner surface for engagement at 299 with an outer radial surface on wedge actuator member 283. In closed latched position of latch means 61, top cap 296 is positioned so that diametrically opposite piston and cylinder means 300 are in collapsed position, cylinder 301 being pivotally connected at 302 to brackets on the cap 295 and rod 303 being pivotally connected at 304 to a bracket 305 carried by wedge actuator ring 283. In closed position of cap 295 as illustrated, upstanding register pins 307 on wedge means 283 have entered ports 308 in top wall 296** of the cap to maintain vertical and coaxial alignment of the cap and wedge actuator means.

In operation of quick latch means 61, in landed position and before engagement of the slip elements 288 with threads 290 on the tension string, the hydraulically actuated pins 275 are retracted so that wedge member 283, slip ring 288, and top cap 295 are rotatable with respect to the top portion of the tension member. When a rough tension force of about 300–400,000 lbs. is placed on the tension string, the top cap 295, slip ring 28B and wedge member 283 are rotated to engage the threads on the tension member. Since the threads may have a pitch of about one inch and the diameter of the tension member may be about twelve inches, it will be apparent that threaded engagement is readily accomplished. Slip elements 288 are provided with finished surfaces at their back edges for engagement with the wedge member landing seat 287 when the cap, slip ring, and wedge member are turned sufficiently so that the wedge member is seated on the upper wall 273 of the piston 263. Pins 275 are then actuated to to secure the wedge member against relative movement with respect to the piston. Stop blocks 285*a* positioned in selected spaced relation in groove 285 limits relative rotation when pins 275 are actuated into radial inward position. When the wedge member 283 has been secured in relation to the piston member, the top cap 295 is drawn downwardly by the cylinder means 300 to tightly contain the slip ring 288 between the wedge member 283 and the cap 295. Because of the wedge relationship of the slip ring it is urged into tight engagement with threads 290 on the top portion of the tension string.

When it is desired to equalize tension between the different tension strings at a columnar buoyant member 22, fluid pressure is introduced into chamber 266 to raise the piston upwardly and to thereby increase tension on tension member 56 and the connected tension string. Such fluid pressure may be provided by an accumulator (not shown) on deck 22. A tension gauge is also provided to indicate tension on the tension string. Register pin 307 extending from the top of wedge member 283 is received within a thru port in the top wall 29 f the cap 295 to prevent relative rotation of the cap and wedge member so that cylinder means 300 can function without binding. When the top of register pin 307 is flush with the top surface of the top wall 296 of the cap, the slip elements 288 are in full tight engagement with threads 290. When the slip element 288 are in such full engagement with threads 290, slip elements 288 are in abutment with or bottom out on the lower shoulder 308 on wedge member 283.

When it is desired to release the quick latch means from the upper tension member 56 of a tension string, the tension member installation rig 100 at the top of the column is axially aligned with the selected tension string. A handling joint (not shown) is connected to the top connecting portion 250 of the upper tension member 260 and the tension load supported by quick latch means 61 is transferred to the installation rig 100. Hydraulic pressure is applied to cylinder means 300 to urge top cap 295 and slip elements 288 upwardly as the tension load is transferred to the installation rig 100. When the tension is relieved from the quick latch means 61, the tension string 56 may be moved either axially or rotated with respect to the quick latch means for the purpose of removal or adjustment.

It should be noted that when the rough tension forces are first applied to the tension string by the installation rig 100 the piston member 263 is in down or retracted position, the pins 275 are retracted and the wedge member, slips and top cap separated from the piston member.

It should be noted that when the rough tension force is first applied to the tension string by the installation rig 100, the piston member 263 is in down or retracted position, the pins 275 retracted and the wedge member, slips, and top cap separated from the piston member. After the tension load is applied to the desired extent by rig 100, the assembly of top cap, slip elements and wedge member are rapidly rotated on the tension string threads 290 until the pins 275 can be actuated to retain the wedge member on the piston member. Slip elements 288 are made of a plurality of annular segments such as from 6 to 12 and are provided sufficient spacing, for example, a quarter of an inch between individual slip elements. The slip elements are quickly engaged with the threads 290 by actuation of the cylinder means 300 and the wedge relationship with the wedge member. Actuation of the piston member 263 to its uppermost position provides a very tight engagement of the slip elements into the threads of the tension string to securely interconnect the top end of the tension string with the platform deck and hawse pipe through the quick latch means.

In the method of installing the tension leg means at a well site, the anchor pile guide means 80 may be lowered to the sea floor at a suitable distance and spacing from the selected drill hole. Each anchor pile guide means is preferably located directly vertically below its corresponding vertical buoyant columnar member 22 of the platform. Pile members are installed and cemented at each of the pile guide means by lateral shifting the platform to facilitate the drilling at each of the spaced locations of the anchor pile guide means. After the anchor pile guide means are installed and pile members cemented in the sea floor, a tension pipe string is installed for each of the anchor pile guide means. It is contemplated that only one tension string will be initially run in each column and is lowered to a point spaced just above the corresponding tension pile connector. One tension string is run in for each platform corner columnar buoyant member 22. All four of the tension string connections are then completed to the anchor pile members. During this connecting operation part of the pile loading is carried by rigs 100 above each tension leg means. The rigs act as heave compensators at the platform deck. After a tension string is connected at each corner column 22 of the platform with its corresponding pile member at the sea floor, the tension on each of the four tension strings is increased equally and to a level bringing the platform into a tension-moored mode. It is anticipated that this operation would be conducted during mild weather where a lower tension would be adequate to achieve a preliminary tension mooring. Once the initial members are installed under tension the remaining tension strings may be run in to connect the remaining three pile members and platform. The tension string assembly may embody the same construction as that above described. When all of the tension strings have been connected between the anchor pile members and the platform and the tension strings have been substantially equalized in tension load, the tension member stabilizers may be energized with fluid pressure to bring the rubber expandable element into engagement with the hawse pipes.

The catenary mooring lines and temporary anchors may now be retrieved. The virtual mass trap means 27 may be removed and retrieved as described above. The platform now embodies substantially only tension leg design characteristics. The platform is now connected to the permanent anchors and is in preliminary tension leg mode. The tension leg means may now be placed under required tension leg tension by changing the ballast in the horizontal and vertically buoyant members. Preferably, the conversion from semisubmersible mode to tension leg mode is accomplished in relatively calm weather with the platform positioned at a desired draft.

It will be understood that various changes and modifications may be made in the tension leg means and method of installing the same that fall within the spirit of this invention and all such changes and modifications coming within the scope of the appended claims are embraced thereby.

We claim:

1. In a method of conducting offshore well operations including exploration drilling and production from a single floatable platform having vertical and horizontal buoyant members adapted to be ballasted and deballasted, provided with drilling and production equipment, and including means for anchoring and utilizing said platform in semi-submersible exploratory mode with catenary mooring and means for anchoring and using said platform in tension leg production mode with tension legs, comprising the steps of:

towing said platform to an ocean well site;

mooring said platform with virtual mass trap means in semisubmersible mode over said site with catenary mooring lines and temporary anchor means;

conducting exploration and drilling operations from said platform in semisubmersible mode at said site to establish production capabilities of said well site;

lowering and setting anchor guide means at selected anchor locations at said site and beneath said platform while said platform is in semisubmersible mode;

shifting said platform in semisubmersible mode for drilling at each anchor guide means;

setting permanent anchor members in the sea floor at said anchor guide means;

connecting tension leg means to said anchor members and to said platform;

initially tensioning said tension leg means to a selected tension;

releasing said platform from said catenary mooring mode;

rendering inoperable said mass trap means; and further tensioning said tension leg means by deballasting certain buoyant members for operation of said platform in tension leg mode.

2. A method as stated in claim 1 wherein during semisubmersible mode the connecting of said tension leg means to said anchor member includes the step of:

providing a connection to said anchor member at the lower end of said tension leg means.

3. A method as stated in claim 2 including providing a flexible joint at the lower end of said tension leg means above said anchor connection.

4. A method as stated in claim 3 including the step of providing a flexible joint at the upper portion of said tension leg means below said platform.

5. A method as stated in claim 4 including the steps of running said tension leg means through a hawse pipe in said platform;

and providing a lateral stabilizing means in said tension leg means at the lower portion of said hawse pipe.

6. In a method as stated in claim 5 including the step of:

landing a latch means on the deck of said platform at said hawse pipe for cooperable engagement with the top end of said tension leg means.

7. In a method as stated in claim 1, wherein anchor guide means includes a plurality of guide conductors each for an anchor pile member and said tension leg means includes a plurality of tension leg strings each adapted for connection to an anchor pile member and a latch means on said platform, including the steps of:

interconnecting each tension leg string in said tension leg means with an anchor pile member and with a latch means;

equalizing tension in each of said tension leg strings to a selected tension before releasing said platform from said catenary mooring mode.

8. A method as stated in claim 7 including the step of adjusting the tension of each of said tension leg strings to equalize the tension in said tension leg strings and tension leg means.

9. In a mobile offshore marine platform provided with means for temporarily anchoring said platform in semsubmersible catenary anchor mode and at a selected draft for conducting exploratory drilling, and provided with means for permanently anchoring said platform in tension leg mode for conducting production activities, the provision of:

means for anchoring said platform in semisubmersible catenary anchor mode and at a selected draft;

means for converting said platform from semisubmersible catenary anchor mode to a platform in tension leg mode; and including mass trap means operable in semisubmersible mode and inoperable in tension leg mode, said converting means including anchor pile guide means carried by said platform and adapted to be lowered to the sea floor;

means on said platform for installing anchor members in said guide means by laterally shifting said platform in catenary anchor mode; and including anchor setting means operable thru said guide means;

tension leg means interconnecting said anchor members and said platform;

means for uniformly tensioning said tension leg means;

means for releasing said platform from said catenary anchor mode;

and means for positioning said platform at a selected draft in tension leg mode.

10. A platform as stated in claim 9 including a vertically disposed column buoyant member;

a hawse pipe in said column member, and a laterally expandable stabilizer means on said tension leg means for engagement with the bottom portion of the hawse pipe.

11. A platform as stated in claim 9 including means for landing the upper end portion of said tension leg means on the platform deck;

said landing means including latch means for interengagement with the upper end of the tension leg means;

and means for adjusting tension of said tension leg means in said landing latch means.

12. A platform as stated in claim 9 wherein said tension leg means includes flexible joint means adjacent said anchor structure and said platform.

13. A platform as stated in claim 9 wherein each of said tension leg means includes a plurality of tension leg pipe members;

said anchor means includes a guide structure for said plurality of tension leg pipe members;

and a plurality of hawse pipes at said platform for receiving upper portions of said tension leg means.

14. A platform as stated in claim 13 wherein each of said tension leg means include four strings of said tension leg pipe members.

15. A platform as stated in claim 11 wherein said latch means connecting said upper end of a tension leg means with the platform includes means for securing and retaining said upper end of said tension leg means at a selected tension.

16. In a method of conducting offshore well operations including exploration, drilling, and production from a single floatable vessel provided with drilling and production equipment on its deck comprising the steps of:

towing said vessel to an ocean well site;

mooring said vessel in a catenary mooring mode over said site with temporary anchor means;

conducting exploration operations from said vessel at said site to determine production capabilities of said well site;

setting anchor means at selected anchor locations beneath said vessel while said vessel is in a catenary moored mode;

shifting said vessel in catenary anchor mode for drilling at each anchor means to set anchor members;

connecting a tension leg means to said anchor means and to the vessel;

tensioning said tension leg means to a selected tension;

releasing said vessel from said catenary mooring mode;

and tensioning said tension leg means for production operation in taut mode.

17. In a marine platform construction adapted for operation in semi-submersible mode and tension leg mode, the combination of:

means including buoyant members having displacement relationships tending to neutralize vertical forces and to stabilize the platform in heave, pitch, and roll, said buoyant members including horizontal buoyant members and vertical buoyant members connected to said horizontal buoyant members and adapted to support a platform deck, and virtual mass trap means associated with said vertical buoyant members in spaced relation to said horizontal buoyant members adapted to minimize heave response when said platform is operated in semi-submersible mode, said mass trap means being rendered inoperable when said platform is operated in tension leg mode.

18. A marine platform construction as stated in claim 17 wherein said virtual mass trap means includes one or more plate-like members extending horizontally between said vertical buoyant members and having horizontal areas large in area for operation of the platform in semi-submersible mode.

19. In a platform construction as stated in claim 17 wherein said buoyant members include horizontal buoyant members having a vertical cross sectional area aspect ratio of about 3 or less.

20. A platform construction as stated in claim 19 wherein said virtual mass trap means is provided with an aspect ratio substantially greater than 3 and cooperable with said horizontal buoyant members.

21. A platform construction as stated in claim 17 wherein said vertical mass trap means includes plate-like members between said vertical buoyant members;

and means for mounting said plate-like members on said vertical members in spaced relation to said horizontal buoyant members.

22. A platform as stated in claim 21 wherein said mounting means includes mounting members on said vertical buoyant members and having landing surfaces, said plate-like members having corresponding surfaces cooperable with said landing surfaces.

23. A construction as stated in claim 21 including mounting members on said vertical buoyant members and having landing surfaces, said plate-like members having corresponding surfaces cooperable with said landing surfaces, and lock means on said plate-like members cooperable with means on said mounting means for securing said plate-like members to said mounting means and said associated vertical buoyant members.

24. In a marine platform construction adapted for operation in semi-submersible mode and tension leg mode, the combination of:

means including buoyant members having displacement relationships tending to neutralize vertical forces and to stabilize the platform in heave, pitch, and rol;

virtual mass trap means associated with certain buoyant members adapted to minimize heave response when said platform is operated in semi-submersible mode, said mass trap means being rendered inoperable when said platform is operated in tension leg mode;

said virtual mass trap means including plate-like members between said certain buoyant members;

means for mounting said plate-like members on said certain members;

and wherein said mounting means is adapted to receive said plate-like members in a vertical direction, said plate-like members being provided neutral buoyance during approach to landing surfaces on said mounting members and being provided slightly negative buoyancy upon landing thereon.

25. In a method of conducting offshore well operations including exploration, drilling, and production from a single floatable vessel provided with drilling and production equipment on its deck, comprising the steps of:

towing said vessel to an ocean well site;

mooring said vessel in a catenary mooring mode over said side with temporary anchor means;

conducting exploration operations from said vessel at said site to determine production capabilities of said well site;

setting anchor means at selected anchor locations beneath said vessel while said vessel is in a catenary moored mode;

shifting said vessel in catenary anchor mode for drilling at each anchor means to set anchor members;

connecting a tension leg means to said anchor means and to the vessel;

tensioning said tension leg means to a selected tension;

releasing said vessel from said catenary mooring mode;

tensioning said tension leg means for production operation in taut mode;

providing said vessel with horizontal buoyant members having a cross-sectional area aspect ratio greater than that provided for in an optimum tension leg platform construction; and providing virtual mass trap members in spaced relation above said horizontal buoyant members.

26. In a marine platform construction, the combination of:

a platform deck a plurality of submergible buoyant members supporting said platform deck;

the displacement ratio of said buoyant members tending to neutralize vertical forces acting on the platform construction when in tension leg mode which includes tension legs extending between said buoyant members and leg anchor means in the sea floor;

virtual mass trap means extending horizontally, positioned below said deck, and associated with said buoyant members;

said virtual mass trap means including mass trap members having relatively large horizontal flat surface areas operative as mass trap means when said platform construction is operated without said tension leg in semi-submersible mode which includes catenary anchor lines extending between said platform structure and said sea floor;

and means for mounting said mass trap members for rendering said mass trap members inoperable when said platform construction is in tension leg mode.

27. A platform construction as stated in claim 26 wherein said buoyant members include horizontal buoyant members having a vertical height to width cross-sectional area aspect ratio of greater than one;

and wherein said virtual mass trap members are provided with a vertical to width aspect ratio of less than one.

28. In a platform construction as stated in claim 26 including retrievable anchors for connection to said catenary anchor lines for mooring said platform construction in semi-submersible mode;

said leg anchor means being substantially directly beneath said platform for connection to said tension legs for using said platform construction in tension leg mode;

said retrievable anchors and catenary anchor lines being made inoperable in tension leg mode.

* * * * *